US012467454B2

(12) United States Patent
Huseman et al.

(10) Patent No.: US 12,467,454 B2
(45) **Date of Patent: *Nov. 11, 2025**

(54) FLUID END OF A HYDRAULIC FLUID PUMP AND METHOD OF ASSEMBLING THE SAME

(71) Applicant: GD Energy Products, LLC, Tulsa, OK (US)

(72) Inventors: Ryan Huseman, Quincy, IL (US); Chris Degginger, Tulsa, OK (US); Paul Douglas Cary, Broken Arrow, OK (US); Kyle Christopher Chady, Broken Arrow, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/408,632

(22) Filed: Jan. 10, 2024

(65) Prior Publication Data

US 2024/0141888 A1 May 2, 2024

Related U.S. Application Data

(63) Continuation of application No. 17/513,961, filed on Oct. 29, 2021, now Pat. No. 11,905,947.

(51) Int. Cl.
*F04B 53/16* (2006.01)
*F04B 53/22* (2006.01)

(52) U.S. Cl.
CPC ..... *F04B 53/16* (2013.01); *F04B 53/22* (2013.01)

(58) Field of Classification Search
CPC ..... F04B 53/16; F04B 53/22
See application file for complete search history.

(56) References Cited

U.S. PATENT DOCUMENTS 3,435,870 A 4/1969 Neuschotz
4,089,234 A 5/1978 Henson et al.
5,833,017 A 11/1998 Woods et al.
(Continued)

FOREIGN PATENT DOCUMENTS

WO 2020/112235 A1 6/2020

OTHER PUBLICATIONS

Forum Drilling Technologies, "High-Performance Valve Cover Retention System," <https://www.f-e-t.com/images/uploads/data-sheets/Valve_Cover_Retention_System.pdf> publicly available at least as early as Jun. 5, 2018 (2 pages).
(Continued)

*Primary Examiner* — Connor J Tremarche
(74) *Attorney, Agent, or Firm* — Edell, Shapiro & Finnan, LLC

(57) ABSTRACT

A fluid end assembly of a hydraulic fluid pump includes a housing, a plug member, a lock cover, and at least one retention pin. The housing may include at least one bore. The plug member may be positioned at least partially within the at least one bore. The lock cover may be coupled to the housing and configured to retain the plug member within the at least one bore during operation of the fluid end assembly. The at least one retention pin may extend at least partially through a portion of the lock cover to retain the lock cover in a rotational position that retains the plug member at least partially within the bore.

20 Claims, 26 Drawing Sheets

(56) References Cited

U.S. PATENT DOCUMENTS

| | | | | |
|---|---|---|---|---|
| 6,401,758 | B1 | 6/2002 | Ziv-Av | |
| 7,290,560 | B2 | 11/2007 | Orr et al. | |
| 7,341,435 | B2 | 3/2008 | Vicars | |
| 7,770,509 | B2 | 8/2010 | Kennedy et al. | |
| 8,365,754 | B2 | 2/2013 | Riley et al. | |
| 8,915,722 | B1 | 12/2014 | Blume | |
| 9,377,019 | B1 | 6/2016 | Blume | |
| 2005/0089427 | A1* | 4/2005 | Riley | F04B 53/22 417/527 |
| 2007/0103263 | A1 | 5/2007 | Gutierrez | |
| 2008/0152523 | A1 | 6/2008 | Jensen et al. | |
| 2010/0054974 | A1* | 3/2010 | Riley | F04B 39/121 417/437 |
| 2011/0283537 | A1 | 11/2011 | Case et al. | |
| 2015/0115541 | A1 | 4/2015 | Sumikawa et al. | |
| 2017/0107983 | A1 | 4/2017 | Patterson et al. | |
| 2020/0182240 | A1 | 6/2020 | Nowell et al. | |
| 2020/0370548 | A1* | 11/2020 | Chady | F04B 53/10 |

OTHER PUBLICATIONS

Forum Drilling Technologies, "Pumps & Valves: P-Mac Valve Cover System," <https://www.f-e-t.com/images/uploads/data-sheets/PMAC.pdf> publicly available at least as early as Jun. 5, 2018 (2 pages).

Premium Oilfield Technologies, "Sur-Lock Valve Cover System," <https://www.premiumoilfield.com/index.php?option=com_content&view=Article&id=53:sur-lock-valve-cover-system&catid=21:sur-lock-tabs1> publicly available at least as early as Jun. 5, 2018 (2 pages).

Premium Oilfield Technologies, "Sur-Lock Valve Cover System," https://www.premiumoilfield.com/performance-enhancement/sur-lock.html, Apr. 2017, 24 pages.

* cited by examiner

FLUID END OF A HYDRAULIC FLUID PUMP AND METHOD OF ASSEMBLING THE SAME

CROSS-REFERENCE TO RELATED APPLICATIONS

This application is a continuation of U.S. patent application Ser. No. 17/513,961, entitled "FLUID END OF A HYDRAULIC FLUID PUMP AND METHOD OF ASSEMBLING THE SAME," filed on Oct. 29, 2021, which is hereby incorporated by reference in its entirety for all purposes.

FIELD OF THE INVENTION

The present invention relates to a hydraulic fluid pump and, more particularly, to a fluid end assembly of a hydraulic fluid pump. Hydraulic fluid pumps are used to provide high pressure fluids for drilling and fracturing operations. The fluid pumps typically include reciprocating plungers or pistons that provide the necessary high pressure fluid.

BACKGROUND OF THE INVENTION

Plug locks or retaining assemblies for pumps may be used to secure plug members (e.g., valve covers, liners, pistons, stuffing boxes, plungers, etc.) within or proximate to bores in a fluid end housing/module of a pump. These retaining assemblies secure the valves and plug members within or proximate to the fluid end housing of a pump, while also enabling access to the valves and other fluid end components for servicing. Conventional retaining assemblies often impart a preload onto the plug members in order to create an effective and reliable seal during operation of the pump. Thus, conventional retaining assemblies typically require tools for installation/removal of the retaining assemblies on/from the fluid end housing of a pump. The tools needed to remove and/or install the conventional retaining assemblies include, but are not limited to, hydraulic pumps, torque wrenches, drills, and/or impact guns. Because tools are required for installing/removing the conventional retaining assemblies, the process for removing and/or installing these conventional retaining assemblies is both time-consuming and may be dangerous. In addition, conventional retaining assemblies are often constructed from materials that have a limited degree of corrosion resistance, which sometimes results in the conventional retaining assemblies becoming unusable or stuck in the sealed position. Thus, what is needed is a retaining assembly capable of a tool-free operation, that does not impart a preload on the plug members to secure the plug members in place, and that is constructed from materials having a high degree of corrosion resistance.

SUMMARY

In some aspects, the apparatus described herein relates to a fluid end assembly of a hydraulic fluid pump including: a housing having a bore; a plug member positioned at least partially within the bore; a lock cover coupled to the housing and configured to retain the plug member within the bore during operation of the fluid end assembly; and a magnetic retention pin extending at least partially through a portion of the lock cover to retain the lock cover in a position that retains the plug member at least partially within the bore.

In some aspects, the apparatus described herein relates to a fluid end assembly, wherein the plug member is a valve cover that is configured to seal the bore.

In some aspects, the apparatus described herein relates to a fluid end assembly, wherein the plug member is a liner that at least partially extends through the lock cover, the liner including: a first end; a second end opposite the first end; a sidewall spanning from the first end to the second end and defining a conduit that spans through the liner from the first end to the second end; and a flange extending radially outward from the sidewall more proximate to the second end than the first end.

In some aspects, the apparatus described herein relates to a fluid end assembly, further including: a piston movably disposed within the conduit of the liner.

In some aspects, the apparatus described herein relates to a fluid end assembly, further including: a lock coupled to the housing, the lock defining a threaded bore, wherein the lock cover is configured to threadedly engage the threaded bore of the lock to couple the lock cover to the housing.

In some aspects, the apparatus described herein relates to a fluid end assembly, wherein each of the lock cover and the threaded bore of the lock includes broken zero-pitch threads.

In some aspects, the apparatus described herein relates to a fluid end assembly, wherein, when the lock cover is threadedly engaged with the threaded bore of the lock, the magnetic retention pin is disposed within a post bore of the lock to prevent the lock cover from rotating with respect to the lock.

In some aspects, the apparatus described herein relates to a fluid end assembly, wherein the bore is an axial bore defined by a central axis, wherein the central axis extends through the plug member and the lock cover such that the lock cover is axially aligned with the plug member.

In some aspects, the apparatus described herein relates to a fluid end assembly, wherein, when the lock cover is coupled to the housing, the lock cover does not apply a preload against the plug member.

In some aspects, the apparatus described herein relates to a fluid end assembly, wherein the lock cover further includes: a first end; a second end opposite the first end, the first end being disposed proximate the plug member when the lock cover is coupled to the housing; a sidewall extending from the first end to the second end; and a flange extending radially outward from the sidewall between the first end and the second end, wherein the magnetic retention pin at least partially extends through a cutout disposed within the flange.

In some aspects, the apparatus described herein relates to a fluid end assembly, wherein the lock cover further includes: a handle coupled to the flange and extending beyond the first end of the lock cover.

In some aspects, the techniques described herein relate to a method of assembling a fluid end of a hydraulic fluid pump, the method including: inserting a plug member into a bore of a housing of the fluid end; coupling a lock cover to the housing such that the lock cover is positioned over the plug member and retaining the plug member in the bore; and inserting a magnetic retention pin at least partially through the lock cover.

In some aspects, the techniques described herein relate to a method, wherein coupling the lock cover to the housing includes threading the lock cover into a lock, wherein the lock is coupled to the housing of the fluid end.

In some aspects, the techniques described herein relate to a method, wherein the lock cover and the lock include broken zero-pitch threads, wherein threading the lock cover to the lock includes axially inserting the lock cover within the lock and then rotating the lock cover relative to the lock.

In some aspects, the techniques described herein relate to a method, wherein, when the lock cover is coupled to the housing, the lock cover does not apply a preload against the plug member.

In some aspects, the techniques described herein relate to a method, wherein the plug member is a valve cover that includes a circumferential seal, and wherein inserting the valve cover into the bore includes engaging the circumferential seal against the bore of the housing.

In some aspects, the techniques described herein relate to a method, wherein the plug member is a liner that at least partially extends through the lock cover and that defines a conduit configured to receive a piston.

In some aspects, the apparatus described herein relates to a fluid end assembly of a hydraulic fluid pump including: a housing having a bore; a plug member positioned at least partially within the bore; a lock cover axially aligned with the bore of the housing and configured to rotate between an unlocked position and a locked position, where the lock cover is configured to retain the plug member within the bore when in the locked position; and a magnetic retention pin extending at least partially through a portion of the lock cover to retain the lock cover in the locked position.

In some aspects, the apparatus described herein relates to a fluid end assembly, wherein the lock cover further includes: a first end; a second end opposite the first end, the second end being disposed proximate the plug member when the lock cover is coupled to the housing; a sidewall extending from the first end to the second end; a flange extending radially outward from the sidewall between the first end and the second end, wherein the magnetic retention pin at least partially extends through a cutout disposed within the flange; and a handle coupled to the flange and extending beyond the first end of the lock cover.

In some aspects, the apparatus described herein relates to a fluid end assembly, further including: a lock coupled to the housing, the lock defining a threaded bore that is axially aligned with the bore of the housing, wherein the lock cover is configured to threadedly engage the threaded bore of the lock to axially align the lock cover to with the bore of the housing and to couple the lock cover to the housing.

Other aspects of the invention will become apparent by consideration of the detailed description and accompanying drawings.

BRIEF DESCRIPTION OF THE DRAWINGS

The apparatuses, systems, devices, modules, and/or components presented herein may be better understood with reference to the following drawings and description. It should be understood that some elements in the figures may not necessarily be to scale and that emphasis has been placed upon illustrating the principles disclosed herein. In the figures, like-referenced numerals designate corresponding parts throughout the different views.

DETAILED DESCRIPTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the description herein. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Figure 1:
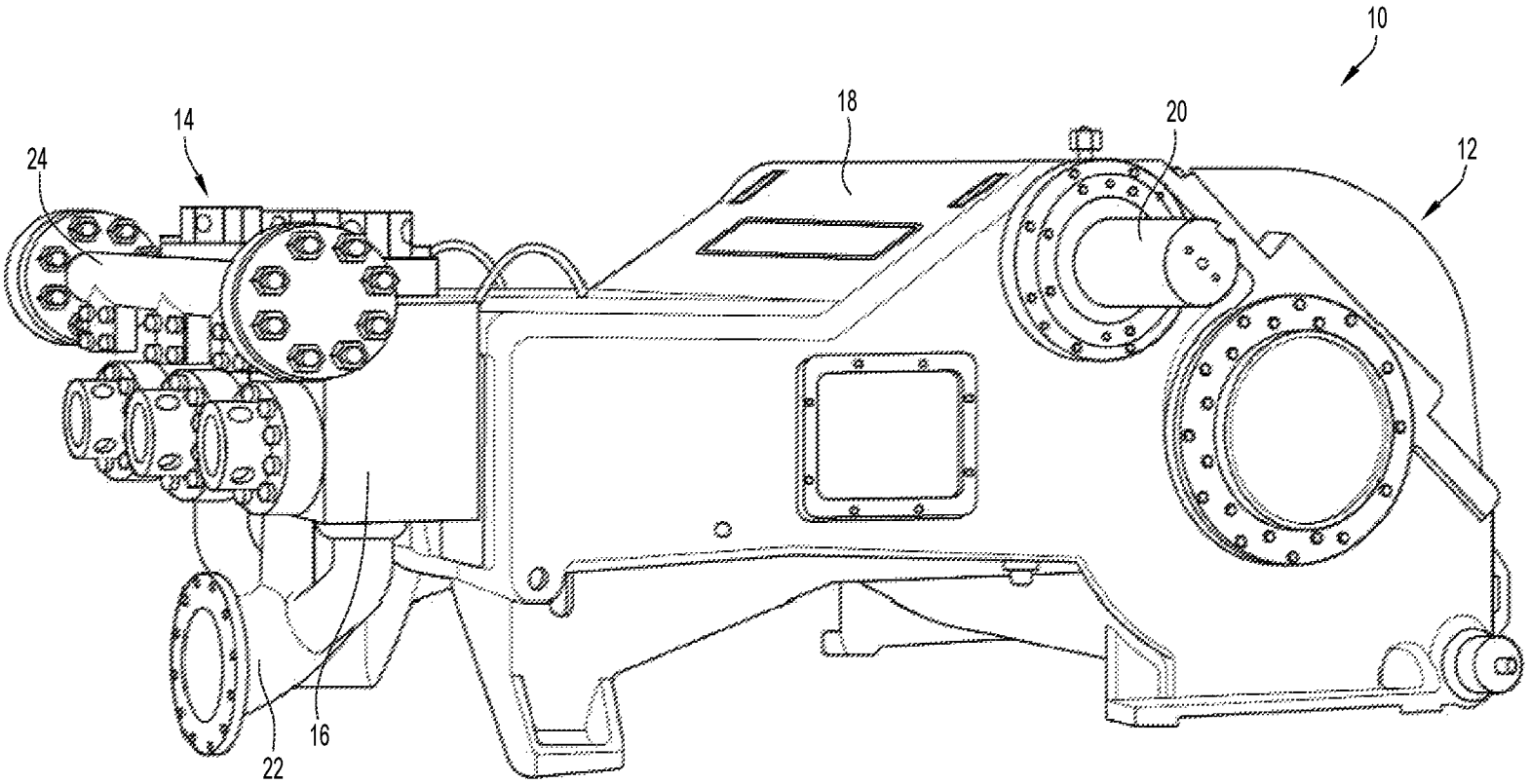
FIG. 1 illustrates a perspective view of a hydraulic fluid pump.

FIG. 1 illustrates a hydraulic fluid pump 10 (e.g., a drill pump) of the type often used during drilling and/or hydraulic fracturing operations such as hydrocarbon or oil fracturing. The hydraulic fluid pump 10 includes a power end or drive end or drive end assembly 12 that is largely enclosed within a casing 18. A fluid end or fluid end assembly 14 attaches to the drive end 12 and the casing 18, and includes at least one fluid end block or drilling module 16. In the embodiment illustrated in FIG. 1, three drilling modules 16 are shown. However, the hydraulic fluid pump 10 may include any number of drilling modules 16 that make up the fluid end assembly 14. A drive shaft 20 extends out of the casing 18 and provides for a connection point for a prime mover such as a motor or engine. The prime mover drives the drive shaft 20 at a desired speed to power the drive end 12. The drive end 12 typically includes a transmission (e.g., gears, belts, chains, etc.) that serve to step down the speed of the drive shaft 20 to a speed appropriate for the fluid end 14. The drive end 12 includes a series of reciprocating mechanisms that in turn drives a piston or plunger within a respective bore of the fluid end block 16 to pump a fluid.

Figure 2:
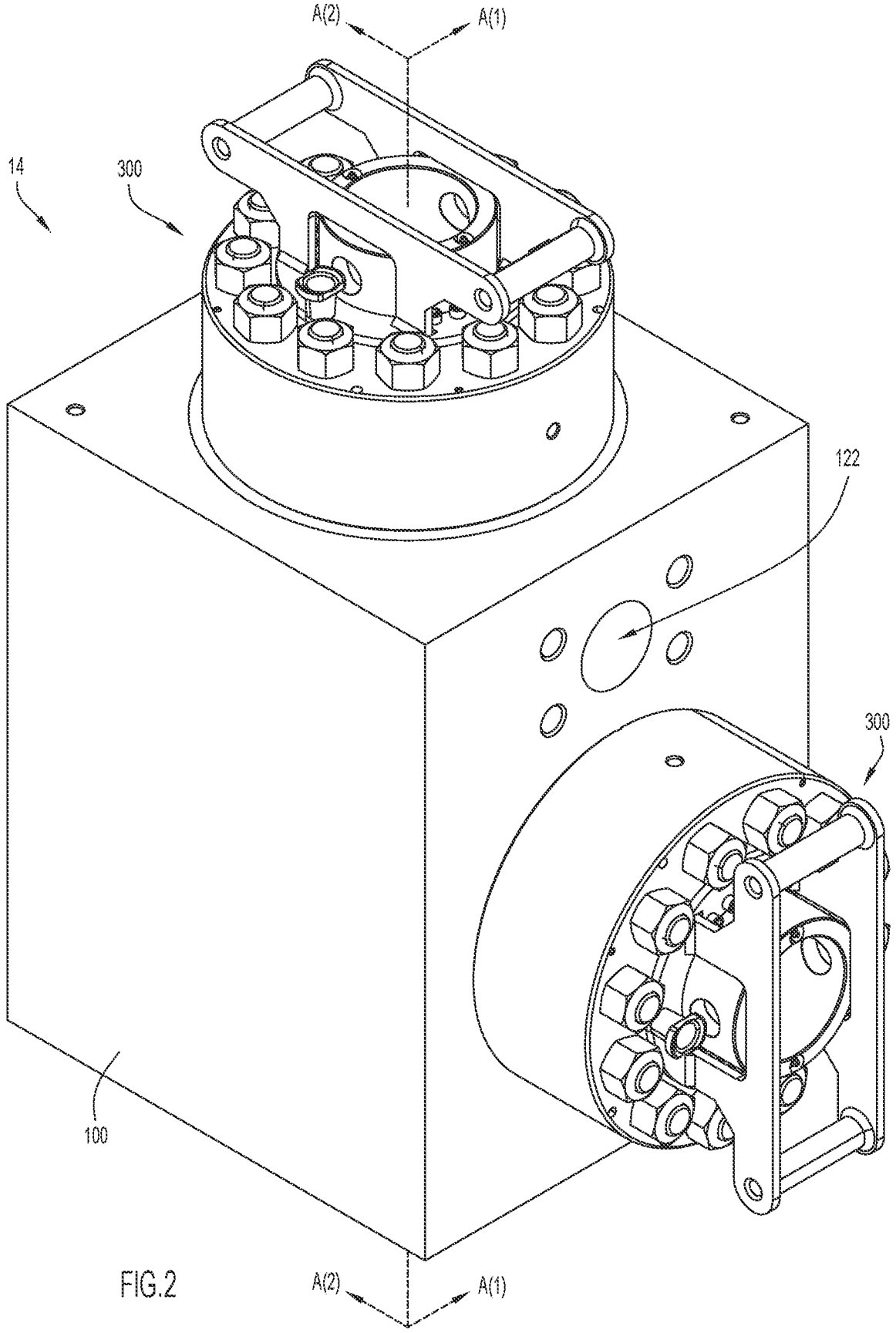
FIG. 2 illustrates a perspective view of retainer assemblies coupled to a fluid end assembly of a hydraulic fluid pump.
Figure 3:
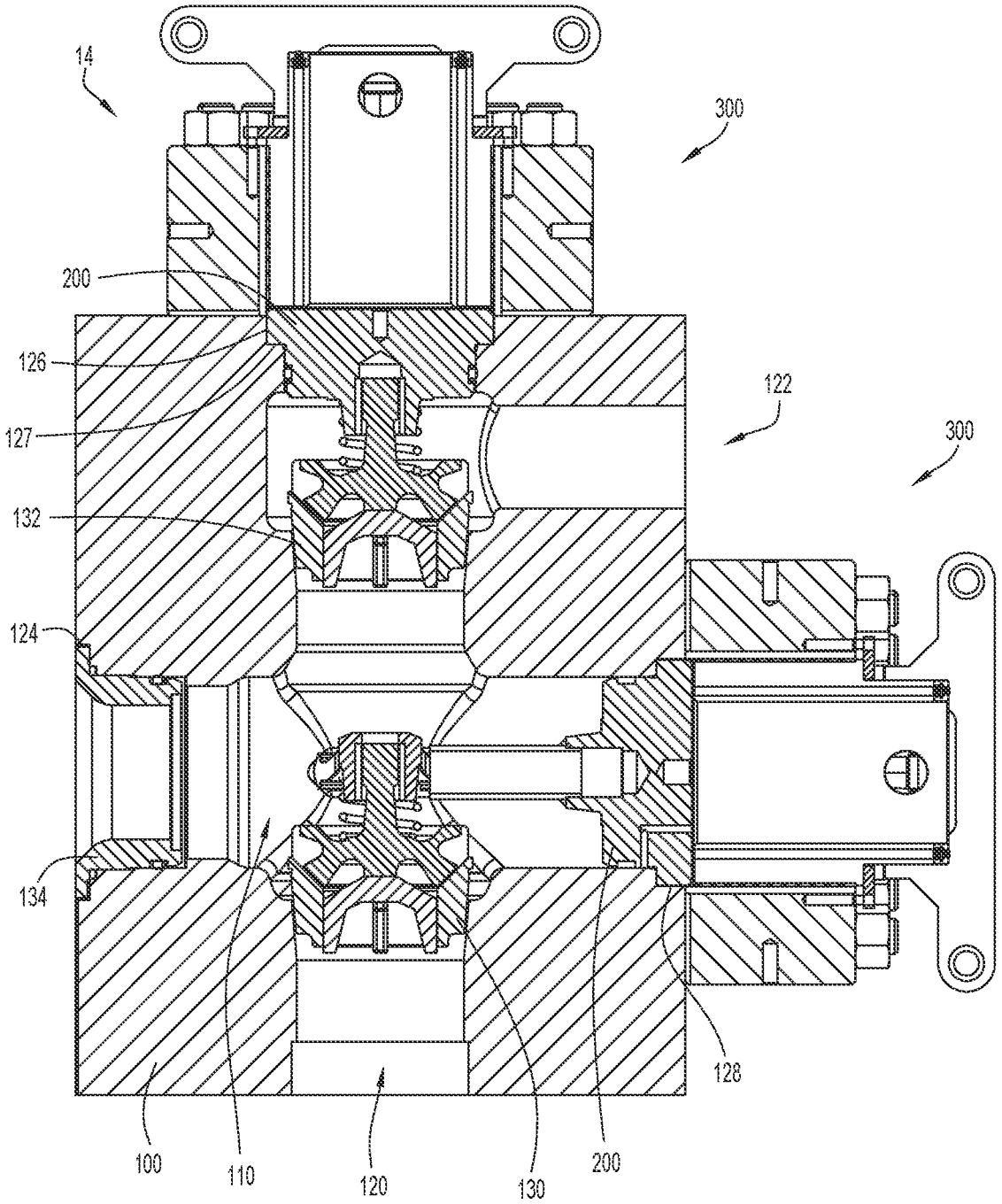
FIG. 3 illustrates a cross-sectional view taken along line A(1)-A(1) of the fluid end assembly and retainer assemblies illustrated in FIG. 2.

An example embodiment of a fluid end assembly 14 of a hydraulic fluid pump 10 is illustrated in FIG. 2, while FIG. 3 illustrates a cross-sectional view of the fluid end assembly 14 illustrated in FIG. 2 taken along line A(1)-A(1). As illustrated, the fluid end assembly 14 includes a housing 100 with valve covers 200 and retainer assemblies 300 coupled thereto.

As best illustrated in FIG. 3, the housing 100 defines the main body of the fluid end assembly 14 surrounding an interior volume 110, the housing having an inlet bore 120, an outlet bore 122, a piston bore 124, and first and second service bores 126, 128. When the fluid end assembly 14 is installed on a hydraulic fluid pump 10, an inlet manifold 22 (shown in FIG. 1) of the hydraulic fluid pump 10 distributes fluid to an inlet bore 120 to interior volume 110 of the housing 100. An inlet valve 130 may be positioned in the inlet bore 120 to control flow from the inlet manifold 22 into the interior volume 110 of the housing 100 of the fluid end 14. The outlet bore 122 directs pressurized fluid from the interior volume 110, past an outlet valve 132, and to an outlet manifold 24 (shown in FIG. 1) fastened to the fluid end 14 and aligned with the outlet bore 122 of the fluid end 14. Thus, the outlet manifold 24 is in fluid communication with the interior volume 110 of the housing 100 via the outlet bore 122 and outlet valve 132.

As further illustrated in FIG. 3, the piston bore 124 extends perpendicular to the inlet bore 120, and supports a packing arrangement having a plurality of seals and a piston retainer 134. A reciprocating piston (not shown) is movable to pressurize fluid within the interior volume 110 and to the outlet manifold 24 (shown in FIG. 1).

With continued reference to FIGS. 2 and 3, the first service bore 126 is formed in the housing 100 adjacent the outlet valve 132 and in fluid communication with the outlet bore 122 at all operative times (i.e., the first service bore 126 is not separated from the outlet bore 122 by the outlet valve 132). The first service bore 126 is axially aligned with the inlet bore 120 and extends into the housing 100 such that it intersects the outlet bore 122. The first service bore 126 provides access to the interior volume 110 for insertion and removal of the outlet valve 132 from the housing 100, and is therefore sized to permit insertion and removal of the outlet valve 132. A second service bore 128 is formed in the housing 100 parallel with, and also axially aligned with, the piston bore 124. The second service bore 128 provides access to the interior volume 110 of the housing 100 without removal of the valves 130, 132, the piston retainer 134, or piston (not shown). The second service bore 128 may additionally provide access for insertion and removal of the piston and/or the inlet valve 130 from the housing 100, and is sized accordingly.

Figure 4A:
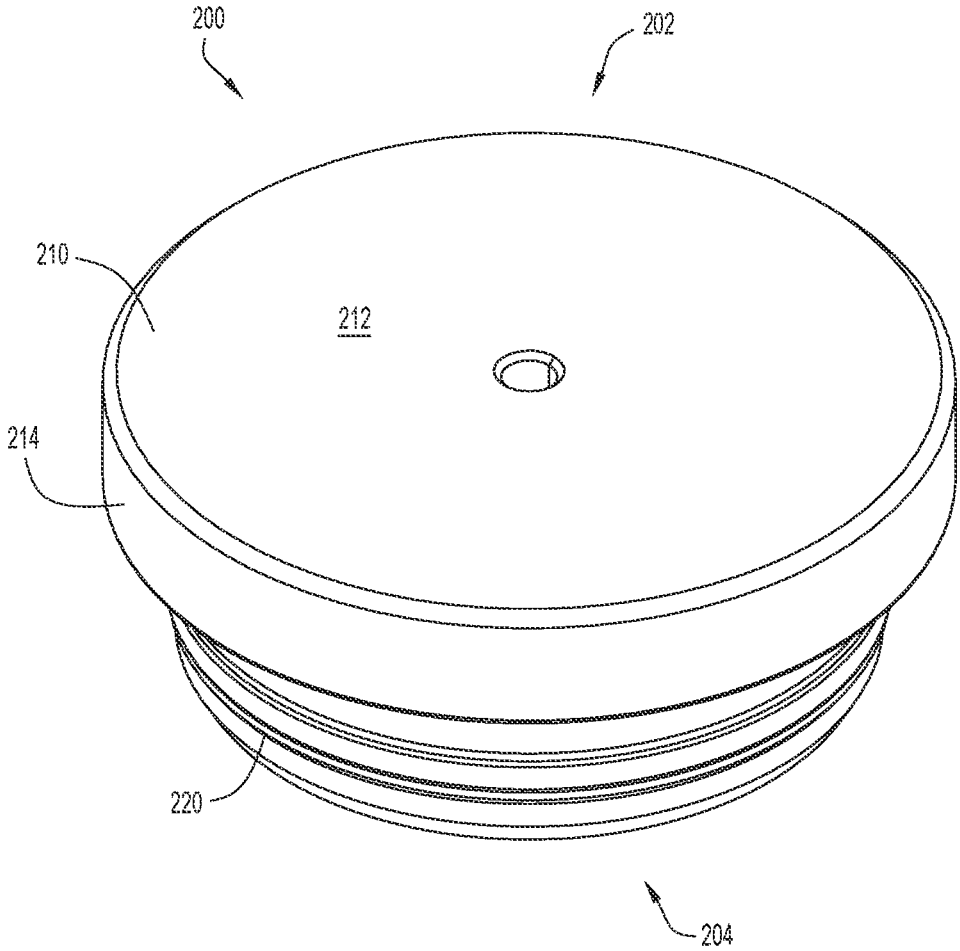
FIGS. 4A and 4B illustrate perspective views of a valve cover for use within the fluid end assembly and the retainer assemblies illustrated in FIG. 2.
Figure 4B:
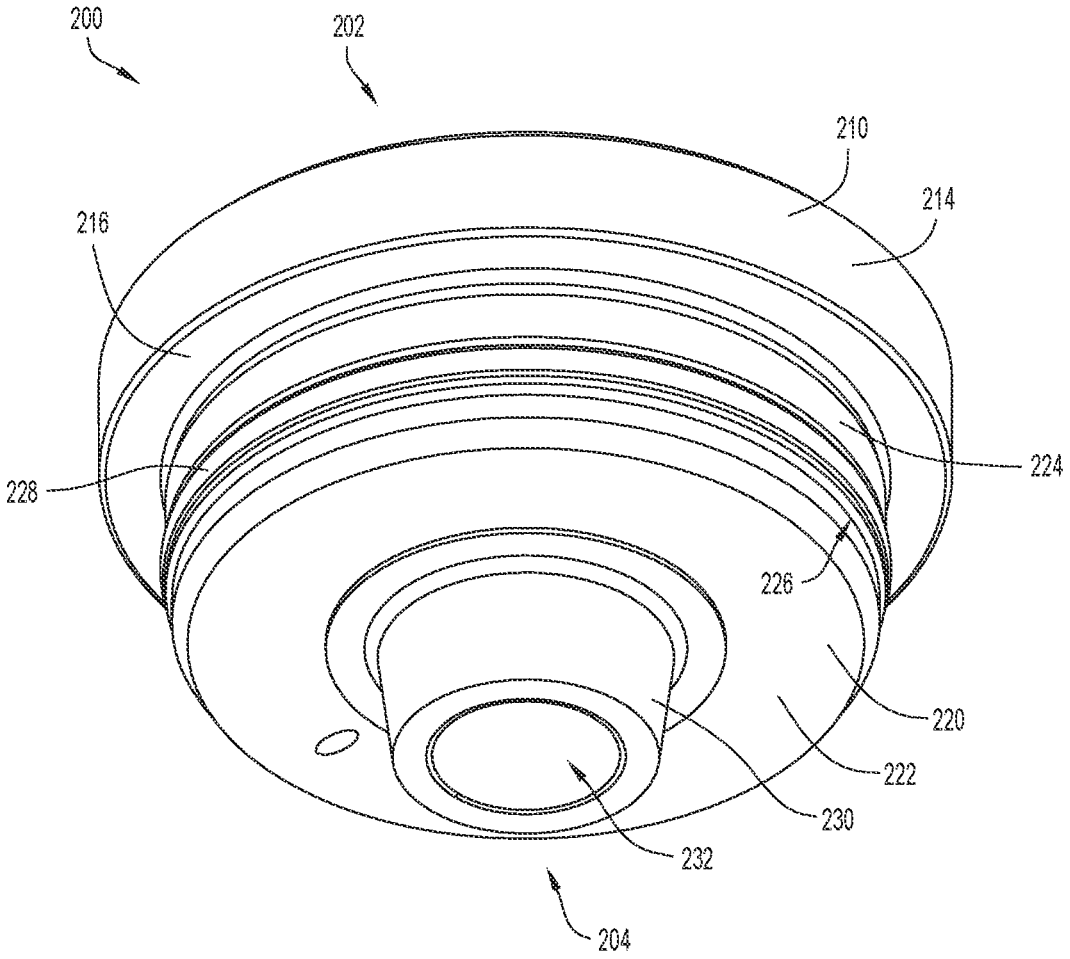

As shown in FIGS. 2, 3, 4A, 4B, and 5, both of the service bores 126, 128 include valve covers 200 and retainer assemblies 300 that are configured to retain the valve covers 200 within the service bores 126, 128. The valve covers 200 seal against the housing 100 to prevent fluid from the interior volume 110 of the housing 100 from passing through the respective service bores 126, 128. Each retainer assembly 300 covers a respective valve cover 200 (or other type of plug member, the valve cover 200 being one of many types of plug members) to retain the valve cover 200 in a sealing position within its respective bore 126, 128. When the reciprocating piston increases the pressure of the fluid within the interior volume 110 of the housing 100, a force is applied on the valve covers 200. While FIGS. 4A and 4B illustrate a single valve cover 200, and while FIGS. 5-10, 11A, 11B, and 12 illustrate a single retainer assembly 300 associated with a valve cover 200, the description of the valve cover 200 and the retainer assembly 300 below applies to both of the valve covers 200 and the retainer assemblies 300 illustrated in FIGS. 2 and 3 because they are substantially identical to one another.

Turning to FIGS. 4A and 4B, illustrated are perspective views of a valve cover 200. As illustrated, the valve cover 200 is a cylindrical plug sized to engage the first service bore 126 of the housing 100. The valve cover 200 may have a first end 202 and an opposite second end 204. The valve cover may further include a first portion 210 disposed more proximate to the first end 202, and a second portion 220 that is disposed more proximate to the second end 204. As illustrated in FIGS. 4A and 4B, the first portion 210 may have a larger diameter than the second portion 220. The differing diameters of the first and second portions 210, 220 may define an outer periphery of the valve cover 200 that is stepped, which may facilitate the valve cover 200 to rest against a lip 127 (best shown in FIGS. 3 and 5) of first service bore 126 of the housing 100 when inserted in an axial (insertion) direction such that the second end 204 of the valve cover 200 is disposed within the interior volume 110 of the housing 100. As best illustrated in FIG. 4A, the first portion 210 includes a planar top or upper surface 212 that may form the first end 202 of the valve cover 200. Thus, the upper surface 212 of the valve cover may be configured to be engage by the lock cover 340 of the retainer assembly 300, as described in greater detail below. As best illustrated in FIG. 4B, the first portion 210 may further include a sidewall 214 and an underside surface or stepped face 216, where the sidewall 214 spans from the underside surface 216 to the upper surface 212. When the valve cover 200 is inserted into the first service bore 126 in an axial (insertion) direction such that the second end 204 of the valve cover 200 is disposed within the interior volume 110 of the housing 100, the underside surface 216 may rest against or abut the lip 127 of the first service bore 126 of the housing 100.

Figure 5:
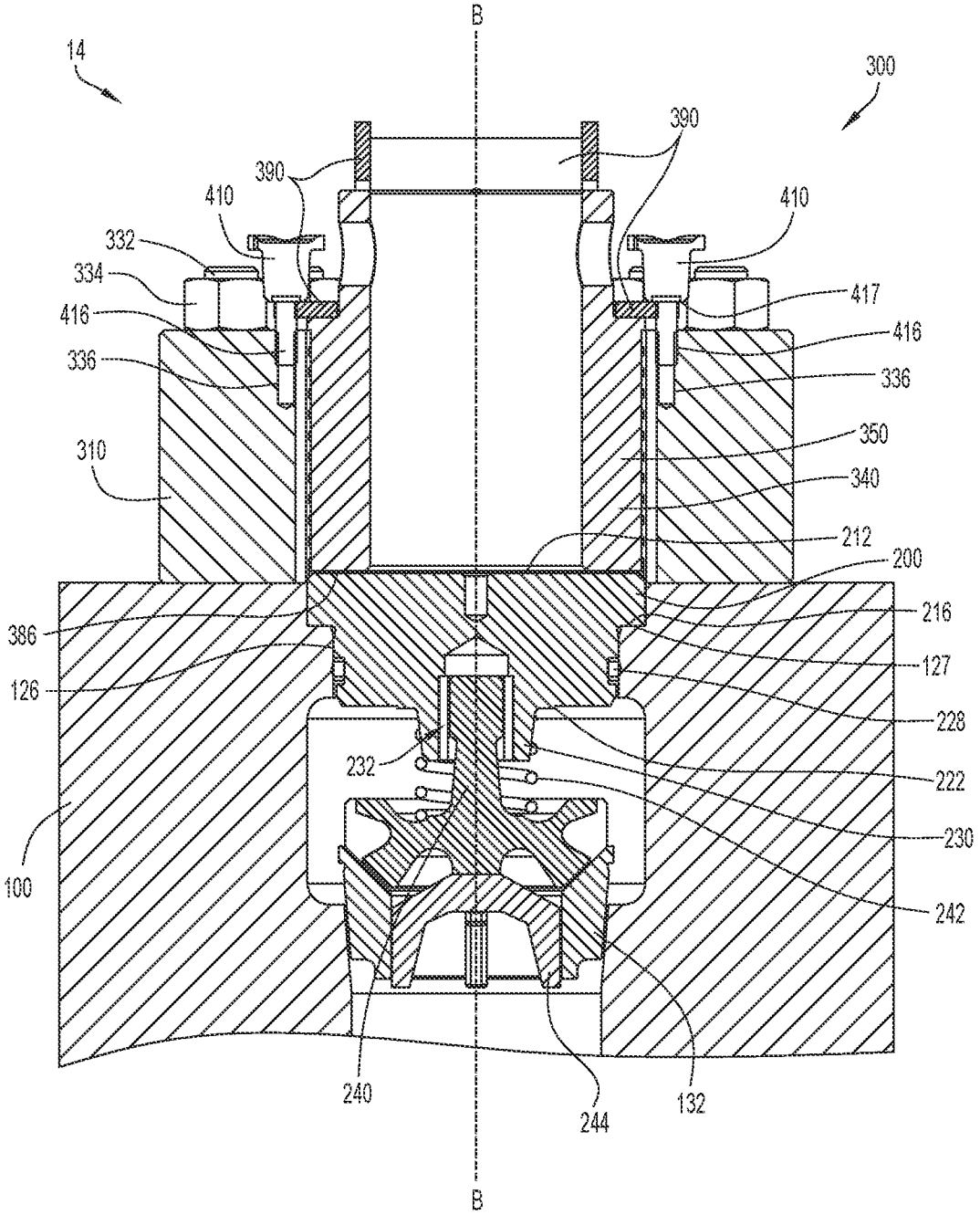
FIG. 5 illustrates a cross-sectional view taken along line A(2)-A(2) of the retainer assembly illustrated in FIG. 2.

The second portion 220 of the valve cover 200 may be axially aligned with the first portion 210, and, as best illustrated in FIG. 4B, may include bottom surface 222 and a cylindrical peripheral surface or sidewall 224 that spans from the bottom surface 222 of the second portion 220 to the underside surface 216 of the first portion 210. Thus, the bottom surface 222 may form the second end 204 of the valve cover 200. Furthermore, the cylindrical peripheral surface 224 may define a groove or cutout 226. A circumferential ring seal 228 (e.g., elastomeric seal) may be positioned within the groove 226 of the valve cover 200 to seal the valve cover 200 relative to the service bore 126. As best illustrated in FIGS. 3 and 5, the seal 228 may be positioned at an axial interface between the valve cover 200 and the housing 100. In other words, the seal 228 is positioned on the cylindrical peripheral surface 224 of the second portion 220 of the valve cover 200 and engages the cylindrical inner surface of the service bore 126. Therefore, the seal 228 is energized with its placement within the service bore 126 of the housing 100 by its frictional engagement with the service bore 126. In contrast, a seal that is located on the underside surface or stepped face 216 of the first portion 210 (not the cylindrical peripheral surface 224 of the second portion 220) of the valve cover 200 and engaging the lip 127 of the service bore 126 of the housing 100 that is, for example, perpendicular to the axial direction of the service bore 126, is only energized by preloading the valve cover 200 against the housing 100.

As further illustrated in FIG. 4B, the second portion 220 of the valve cover 200 further includes a protrusion 230 that extends from the bottom surface 222 of the second portion 220 of the valve cover 200. The protrusion 230 may contain an opening or channel 232 that extends through the protrusion 230 and at least a portion of the second portion 220 of the valve cover 200. As best illustrated in FIG. 5, the channel 232 may be configured to slidably receive a portion or valve shaft 240 of the outlet valve 132, while a spring or resilient member 242 extends from the outlet valve 132, around the protrusion 230, and engages the bottom surface 222 of the second portion 220 of the valve cover 200. The resilient member 242 is configured to retain and position the outlet valve 132 within the outlet bore 122 of the interior volume 110 of the housing 100. The resilient member 242 biases a valve member 244 of the outlet valve 132 in a closing direction.

As FIG. 5 further illustrates, and with continued reference to FIGS. 2, 3, 4A and 4B, the first service bore 126 of the housing 100 of the fluid end 14 is aligned with, and provides access to, the outlet valve 132 positioned within the interior volume 110 of the housing 100. The outlet valve 132 may be configured to control a flow of fluid within the interior volume 110 of the housing 100. The first service bore 126 is sealed by the valve cover 200, which is held in place via the retainer assembly 300. As illustrated and further detailed below, the retainer assembly 300 may include a lock 310, a lock cover 340, and one or more retention pins 410. The retainer assembly 300 retains the valve cover 200 within the first service bore 126 of the housing 100 and counteracts the force applied on the valve cover 200 by pressurized fluid within the interior volume 110 of the housing 100. However, unlike conventional retainer assemblies, the retainer assembly 300 does not apply a preload on the valve cover 200. As previously explained, conventional retainer assemblies apply a preload to an associated valve cover to counteract the force applied by the pressurized fluid and to prevent unseating of the valve cover seal, which is typically a face seal, from the housing/bore of the housing. In contrast to the prior art, the retainer assemblies 300 illustrated in FIGS. 2, 3, and 5 do not require a preload to counteract the force applied by the pressurized fluid, and do not require a preload to prevent unseating of an valve cover seal 228 of the valve cover 200 from the housing 100.

Figure 6:
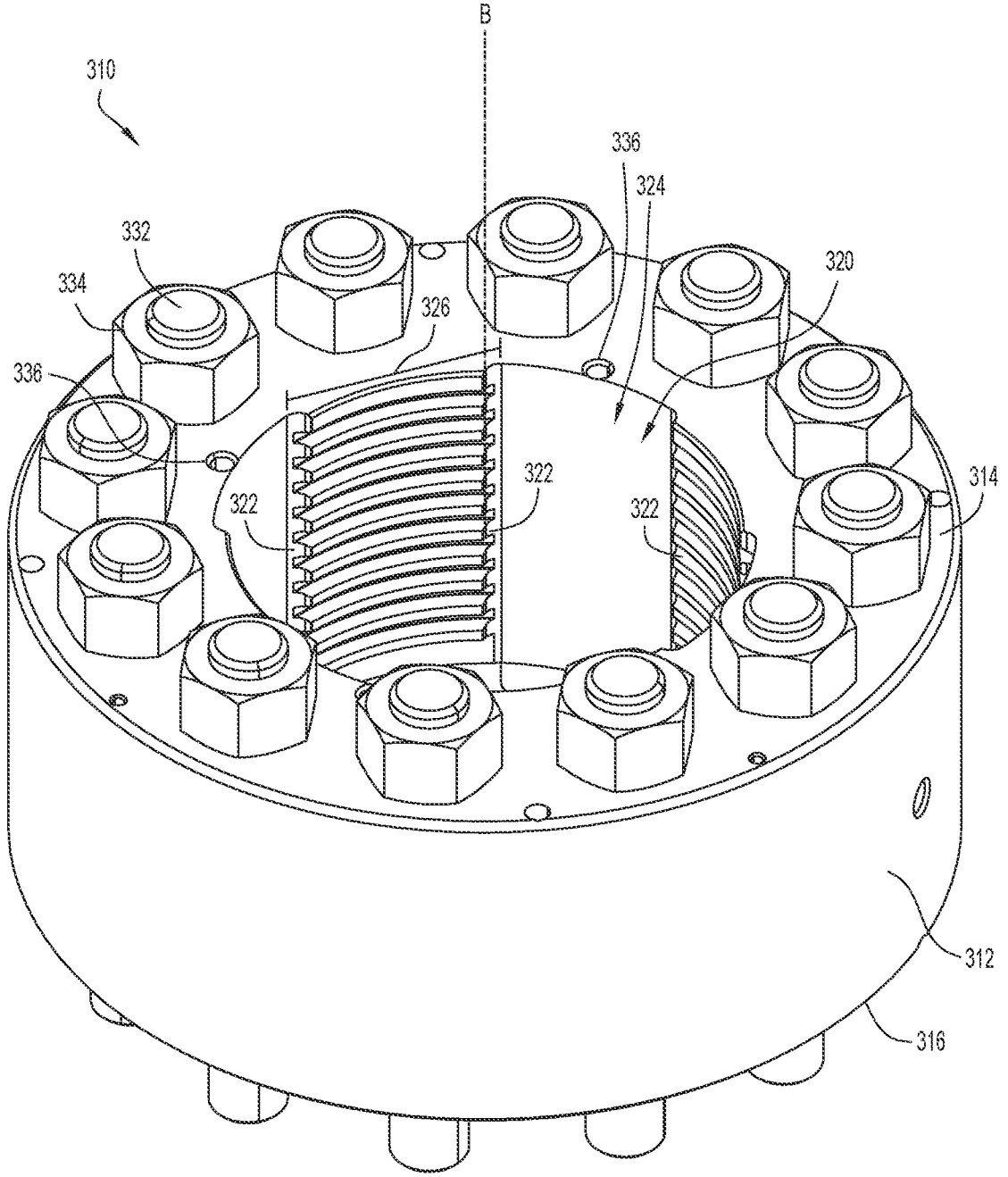
FIG. 6 illustrates a perspective view of a lock of the retainer assembly of FIG. 2, the lock shown with associated fasteners.
Figure 7:
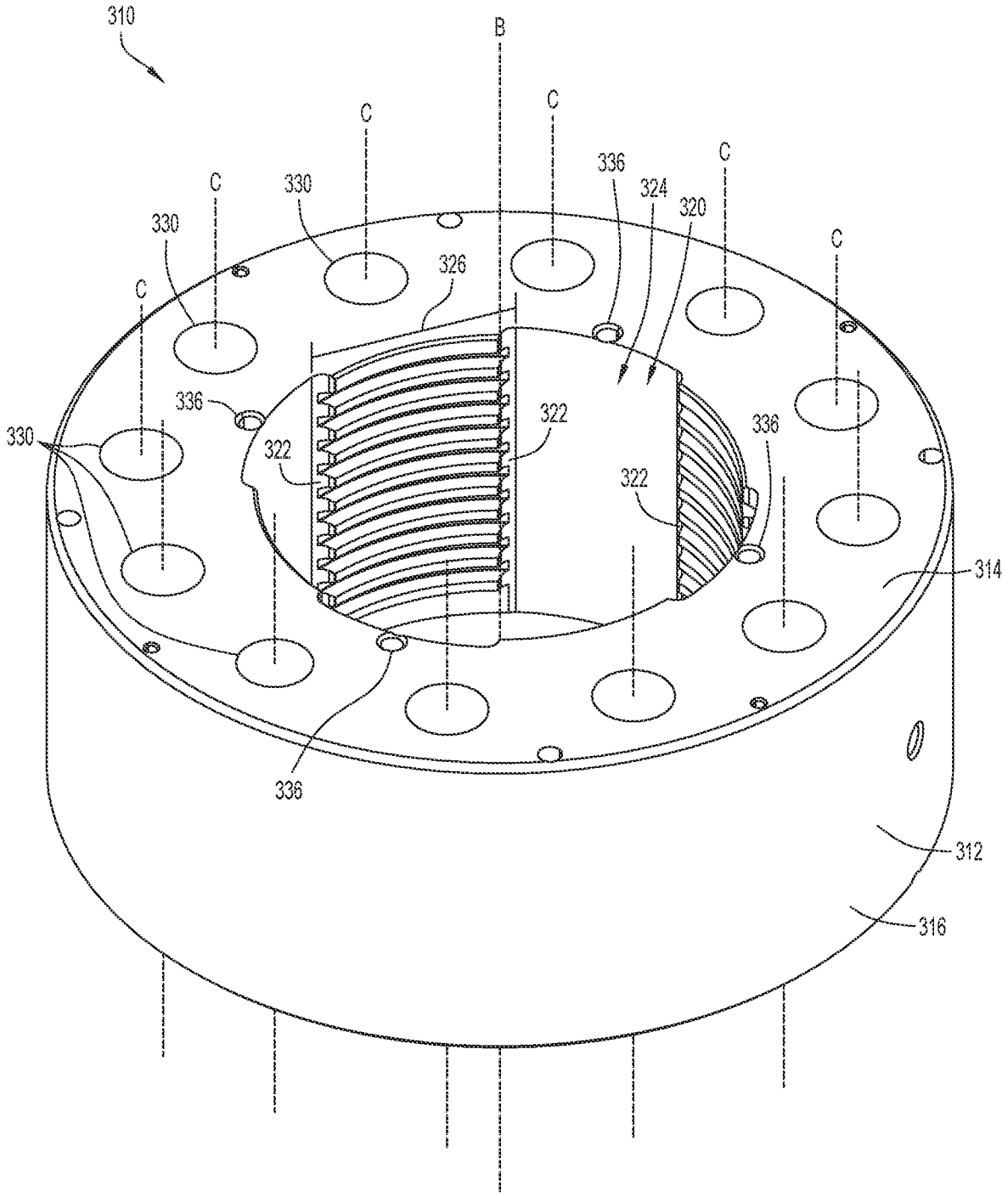
FIG. 7 illustrates a perspective view of the lock of FIG. 6 shown without the associated fasteners.

Turning to FIGS. 6 and 7, illustrated is an embodiment of the lock 310 of the retainer assembly 300, where the lock 310 is a ring having a substantially cylindrical shape. In other embodiments, the lock 310 may be non-cylindrical, or may be formed as a plate that is associated with a plurality of valve covers 200 along a length of the fluid end 14. The illustrated lock 310 includes a sidewall 312 that extends between a first axial end 314 and a second axial end 316. The lock further includes a lock cover bore 320 extending through the lock 310 from the first axial end 314 to the second axial end 316. The lock cover bore 320 is therefore a through-bore extending entirely through the axial length of the lock 310. As shown, the lock cover bore 320 is centered on the lock 310 such that the lock cover bore 320 is coaxial with a central axis B of the lock 310.

As illustrated in FIGS. 6 and 7, the lock cover bore 320 may be a threaded bore, and more specifically, may include a plurality of broken, zero-pitch threads or lugs 322. As shown, the lock cover bore 320 may include twelve threads 322 spaced apart along the length of the bore between the first and second axial ends 314, 316 of the lock 310. In other embodiments, the lock cover bore 320 may include more or less threads 322 (e.g., at least one, at least two, etc.). The threads 322 may have no pitch and are therefore not interconnected with one another as a spiral. Rather, each thread 322 may be flat or planar and may be defined within a plane that is perpendicular to the central axis B of the lock cover bore 320 and parallel with the respective plane of each additional thread 322. In other embodiments, the threads 322 of the lock cover bore 320 may have a pitch along the axial length of the lock 310.

Each of the plurality of threads 322 is broken or interrupted such that each thread 322 is non-continuous, but instead defines a gap 324 at intervals along the thread 322. As shown in FIGS. 6 and 7, each thread 322 of the plurality of threads is broken into four broken thread segments 326 each spanning 45 degrees about the lock cover bore 320, with a gap 324 in between each 45 degree segment. In other embodiments, each thread 322 may be broken into more or less segments 326 (e.g., two broken thread segments 326 each spanning 90 degrees about the lock cover bore 320 and separated by 90 degree gaps 324, three broken thread segments 326 each spanning 60 degrees about the lock cover bore 320 and separated by 60 degree gaps 324, etc.). Further, in some embodiments, the sizes of the gaps 324 may be dissimilar to the sizes of the broken thread segments 326. Each thread 322 of the respective broken thread segment 326 is axially aligned with every other thread of the respective broken thread segment 326 such that the gaps 324 are axially aligned. Therefore, each axial gap 324 extends through the entire lock cover bore 320 between the adjacent broken thread segments 326. In other embodiments, the threads 322 of the lock cover bore 320 may have a pitch along the axial length of the lock 310, and may continuously extend around the lock cover bore 320 (i.e., the threads 322 may not contain any gaps 324).

The lock 310 further includes a plurality of fastener bores 330, which are best shown in FIG. 7, that positioned around the lock cover bore 320. As shown, twelve fastener bores 330 are positioned radially outward from the lock cover bore 320, extending axially through the lock 310 from the first axial end 314 to the second axial end 316. Central axes C of the fastener bores 330 extend parallel to one another and parallel to the central axis B of the lock cover bore 320. The fastener bores 330 may be spaced equidistant from one another about the lock cover bore 320. In the embodiment illustrated, each fastener bore 330 may be spaced apart from the next adjacent bores 330 by approximately 30 degrees.

As shown in FIG. 6, fasteners 332 (e.g., threaded fasteners such as bolts, threaded studs, etc.) may extend through the fastener bores 330. The fasteners 332 may be longer than the fastener bores 330 (i.e., longer than the axial length of the lock 310) such that when the second axial end 316 of the lock 310 is positioned on the housing 100 of the fluid end 14, the fasteners 332 extend through the fastener bores 330 of the lock 310 and into respective threaded fastener bores (not shown) of the fluid end housing 100. As shown, the fasteners 332 may each be a threaded stud, and each fastener 332 may further include an associated nut 334 that is threaded onto the fastener 332 and into engagement with the first axial end 314 of the lock 310. The fasteners 332 may couple the lock 310 to the housing 100 of the fluid end 14.

The lock 310 further includes a plurality of pin bores or retainer bores 336, which extend axially from the first axial end 314 of the lock 310 toward the second axial end 316. The retainer bores 336 are located radially between the lock cover bore 320 and the sidewall 312 of the lock 310 and extend in an axial direction that is parallel to the central axis B of the lock cover bore 320. As shown, the retainer bores 336 may be located more proximate to the lock cover bore 320 than to the sidewall 312 of the lock 310. The retainer bores 336 may be blind holes or blind bores that are formed in the first axial end 314 and may terminate prior to the second axial end 316. As shown, the retainer bores 336 may be unthreaded. In the illustrated embodiment, the lock 310 may contain four retainer bores 336, each offset from one another by ninety degrees about the lock cover bore 320. In some embodiments, the number of retainer bores 336 may correspond to the number of broken thread segments 326 of the lock cover bore 320. The retainer bores 336 will be described in greater detail below with respect to the retention pins 410.

Figure 8:
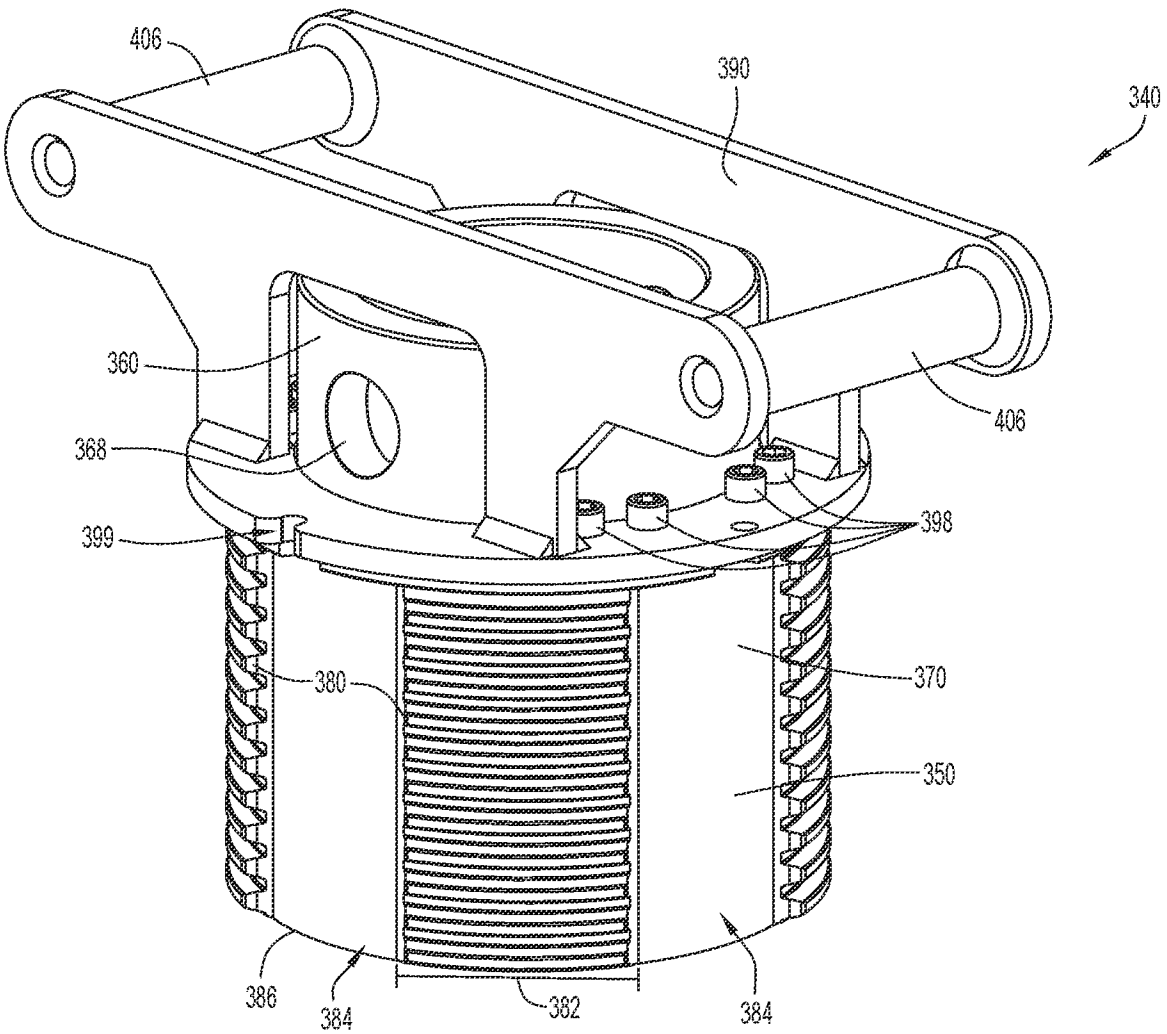
FIG. 8 illustrates a perspective view of a lock cover of the retainer assembly illustrated in FIG. 2.
Figure 9:
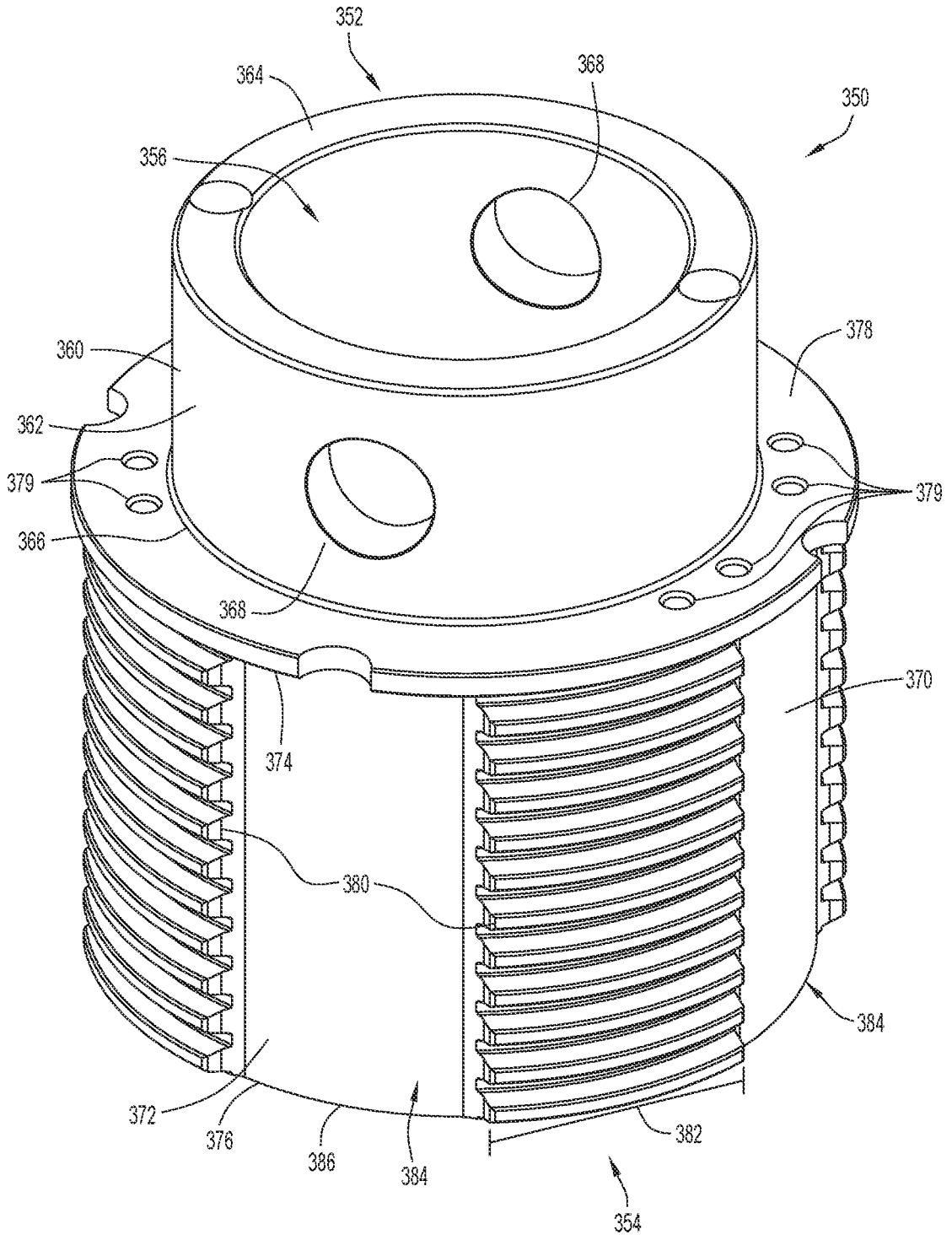
FIG. 9 illustrates a perspective isolated view of the main body of the lock cover illustrated in FIG. 8.
Figure 10:
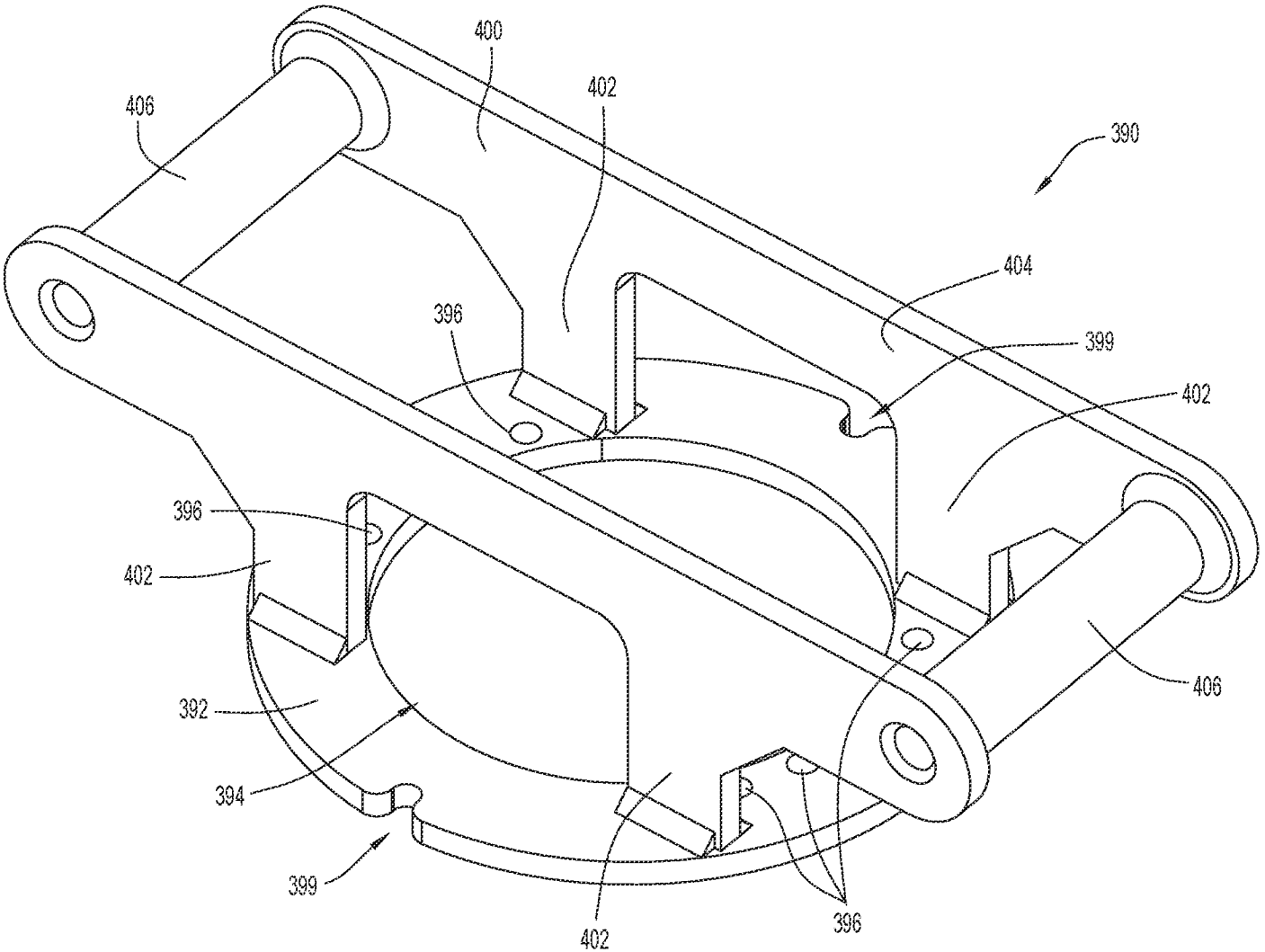
FIG. 10 illustrates a perspective isolated view of the handle of the lock cover illustrated in FIG. 8.

Turning to FIGS. 8-10, illustrated is the lock cover 340 of the retainer assembly 300. The lock cover 340 is configured to be inserted into the lock cover bore 320 of the lock 310 and may be generally cylindrical to facilitate rotation of the lock cover 340 within the lock cover bore 320 and with respect to the lock 310. As best illustrated in FIG. 8, the lock cover 340 may include a main body 350 and a handle 390 coupled to the main body 350.

FIG. 9 illustrates an isolated (i.e., with the handle 390 removed) perspective view of the main body 350 of the lock cover 340, the main body 350 being sized and shaped to fit within the lock cover bore 320 of the lock 310. The main body 350 may have a first axial end 352 and a second axial end 354 opposite the first axial end 352. The main body 350 may also include a central bore 356 that extends through the main body 350 from the first axial end 352 to the second axial end 354.

As further illustrated in FIG. 9, the main body 350 may further include an upper portion 360 and a lower portion 370. The upper portion 360 may be smaller in diameter than the lower portion 370. The upper portion 360 may be substantially cylindrical with a sidewall 362 extending from a first end 364 to a lower end 366. The first end 364 of the upper portion 360 may form the first axial end 352 of the main body 350. The upper portion 360 may further includes various assembly features, such as radial apertures 368 (extending transverse to the central bore 356 of the main body 350 of the lock cover 340) that assist in the installation of the lock cover 340 within the lock 310.

The lower portion 370 may include a substantially cylindrical sidewall 372 that extends from a first end 374 to a second end 376. The second end 376 of the lower portion 370 may form the second axial end 354 of the main body 350. Moreover, the first end 374 of the lower portion 370 may be coupled to the second end 366 of the upper portion 360. Disposed at the coupling of the first end 374 of the lower portion 370 to the second end 366 of the upper portion 360 is a flange 378, which may have a diameter that is larger than both that of the upper portion 360 and the lower portion 370. Thus, the flange 378 may extend radially outward from the main body 350 of the lock cover 340. Disposed on the upper surface of the flange 378 may be a plurality of attachment openings 379 (e.g., threaded bores).

As further illustrated in FIG. 9, the lower portion 370 may be a threaded portion and may include external threads 380 that are similar to the internal threads 322 of the lock cover bore 320. Thus, the external threads 380 may be broken zero-pitch threads sized to engage the broken zero-pitch threads 322 of the lock cover bore 320. As shown, the lower portion 370 of the main body 350 of the lock cover 340 may include eleven threads 380 that are configured to engage within the twelve threads 322 of the lock cover bore 320. The threads 380 are broken such that the broken thread segments 382, which are separated from one another by gaps 384, of the external threads 380 fit within the gaps 324 between the broken thread segments 326 in the lock cover bore 320 (i.e., the external broken thread segments 382 of the lock cover 340 are equal to or less than the size of the gaps 324 in the lock cover bore 320) and the arrangement of the external broken thread segments 382 allow them to each be aligned with, and placed within, respective gaps 324 in the lock cover bore 320. As the external threads 380 are broken, the external threads 380 of the lock cover 340 are engaged with the lock cover bore 320 by first axially inserting the lock cover 340 into the lock cover bore 320 with the external broken thread segments 382 of the lock cover 340 positioned in the gaps 324 defined between the internal broken thread segments 326 of the lock cover bore 320. Once the lock cover 340 is axially positioned within the lock cover bore 320 of the lock 310, the lock cover 340 may be rotated relative to the lock cover bore 320 so that the threads 322, 380 engage one another. For the illustrated embodiment, this includes rotating the lock cover 340 by 45 degrees with respect to the lock cover bore 320. In some embodiments, one pair of mating threads 322, 380 (e.g., the lowest threads) of the lock cover bore 320 and the lock cover 340, respectively, may be larger and/or spaced apart at a greater distance from one another than the remainder of threads 322, 380 so that the lock cover 340 is only capable of engaging the lock cover bore 320 at one axial position along the axial length of the lock cover bore 320. In other embodiments, the length of the lower portion 370 (i.e., the length between the first and second ends 374, 376 of the lower portion 370) may be sized (e.g., have a predetermined length) so that the threads 322, 380 of the lock cover bore 320 and the lock cover 340, respectively, are aligned to facilitate a mating engagement of the threads 322, 380 when the flange 378 of the main body 350 of the lock cover 340 is in abutment with the first axial end 314 of the lock 310. In other embodiments, the threads 380 of the lock cover 340 may have a pitch along the axial length of the lower portion 370 of the lock cover 340, and may continuously extend around the lower portion 370 of the lock cover 340.

In even further embodiments, the lock cover bore 320 of the lock 310 and the lock cover 340 may contain a complementary grove/track and cam arrangement, where one component contains at least one groove, and the other component contains at least one complementary cam that may be received by the at least one groove. In some embodiments, this grove may be L-shaped, while in other embodiments, the groove may spiral around the lock cover bore 320 or lock cover 340. In these embodiments, when the lock cover 340 is inserted into the lock cover bore 320, the cam may be disposed in the groove. As the lock cover 340 descends into the lock cover bore 340 and is placed in a locked position (i.e., fully inserted into the lock cover bore 320, the cam may follow along the groove.

As illustrated in FIGS. 5, 8, and 9, the second axial end 354 (i.e., the second end 376 of the of the lower portion 370) of the main body 350 of the lock cover 340 defines an abutment surface 386 for contacting the first end 202 (e.g., the upper surface 212 of the first portion 210) of the valve cover 200 when the lock cover 340 is installed within the lock cover bore 320 of the lock 310. As shown, the abutment surface 386 directly contacts the valve cover 200, and specifically, as shown in FIG. 5, contacts the radial periphery of the upper surface 212 of the first portion 210 of the valve cover 200. In other embodiments, the abutment surface 386 may indirectly contact the valve cover 200 via an intermediate component.

As previously explained, and as best shown in FIGS. 8 and 10, the lock cover 340 includes a handle 390 that is coupled to the main body 350. The handle 390 may include a lower ring portion 392 and an upper engagement portion 400. As best illustrated in FIG. 10, the lower ring portion 392 may have a substantially ring shape. In other embodiments of the of the handle 390, the lower ring portion 392 may be of any other shape. The lower ring portion 392 may include a central opening 394 and a series of attachment apertures 396. As best illustrated in FIG. 8, when the handle 390 is coupled to the main body 350, the upper portion 360 of the main body 350 may be inserted through the central opening 394 of the lower ring portion 392 such that the lower ring portion surrounds the upper portion 360 of the main body 350. Moreover, when the handle 390 is coupled to the main body 350, the lower ring portion 392 may be in abutment with the upper surface of the flange 378 of the main body 350, and the attachment apertures 396 may be aligned with the attachment openings 379 of the flange of the main body 350. As further illustrated in FIG. 8, fasteners 398 may be inserted through the attachment apertures 396 of the lower ring portion 392 of the handle 390 and into the attachment openings 379 of the main body 350 to secure the handle 390 to the main body 350. As further illustrated, the lower ring portion 392 may also include one or more cutouts 399 disposed in an outer edge of the lower ring portion 392. When the handle 390 is coupled to the main body 350, the lower ring portion 392 may be a flange of the lock cover that extends radially outward from the main body 350 of the lock cover 340.

Continuing with FIGS. 8 and 10, the upper engagement portion 400 of the handle 390 may include a series of upstanding members 402 that extend upwardly from the top surface of the lower ring portion 392. The embodiment of the handle 390 illustrated in FIG. 10 contains four upstanding member 402. The handle 390 may further include two elongated members 404 that extend across the handle 390, where each elongated member 404 is coupled to the ends of two upstanding members 402. The elongated members 404 may be substantially parallel to one another. The handle 390 may further include cylindrical members 406 that extend between opposing ends of the two elongated members 404 to create a handle engagement area of a user. Thus, the handle 390 presents the user with two engagement areas (e.g., the cylindrical members 406) that are opposed to one another and are configured to facilitate ease of rotation of the lock cover 340. In other embodiments, the cylindrical members 406 may be of any shape. In further embodiments, the handle 390 may be of any other shape, structure, and orientation that facilitates ease of insertion and rotation of the lock cover 340. In even further embodiments, the handle 390 may be integrally formed with the main body 350. In yet even further embodiments, the lock cover 340 may not contain a handle 390, and instead the cutouts 399 may be formed in the flange 378 of the main body 350 of the lock cover 340.

Figure 11B:
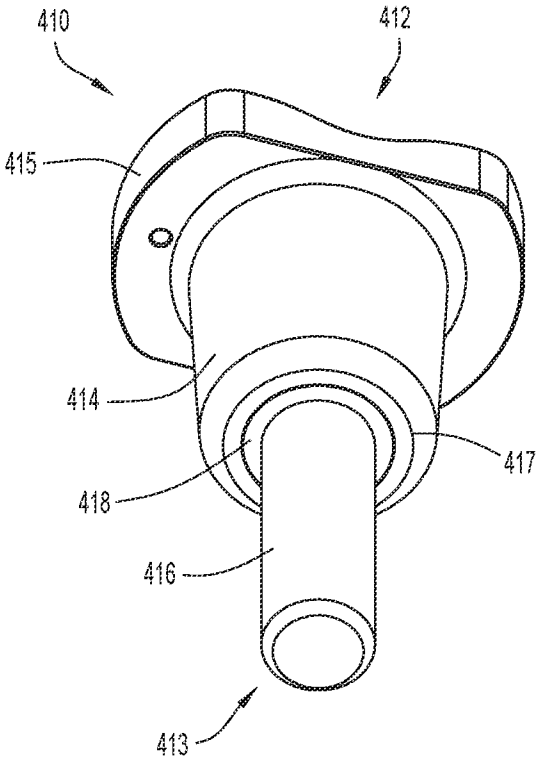
FIGS. 11A and 11B illustrate perspective views of the retention pins of the retainer assembly illustrated in FIG. 2.
Figure 11A:
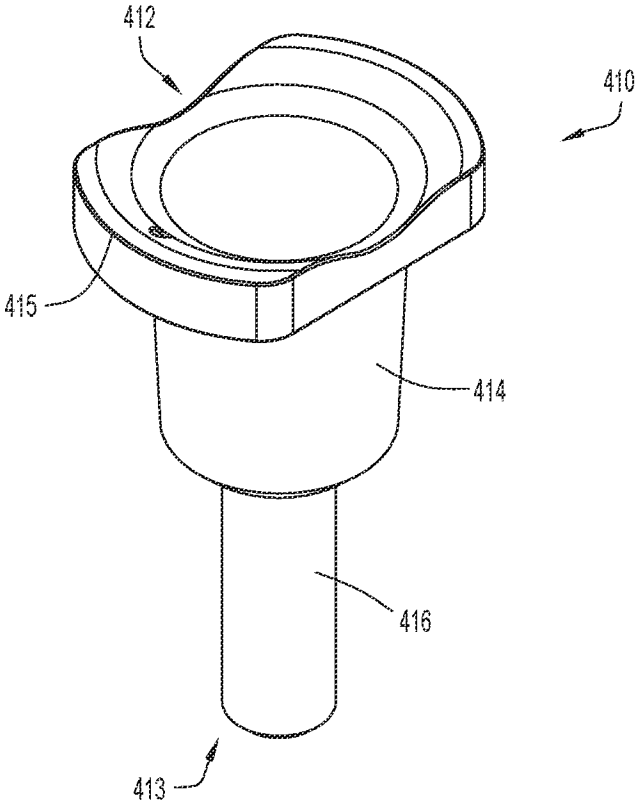

Turning to FIGS. 11A and 11B, illustrated is an example embodiment of the retention pin 410. The pin 410 may be substantially elongated with a first end 412 and an opposite second end 413. Disposed between the first end 412 and the second end 413 may be an intermediate portion 414 that may be substantially cylindrical in shape. As illustrated in FIGS. 11A and 11B, the pin 410 includes an engagement flange portion 415 disposed at the first end 413, where the engagement flange portion 415 extends radially outward from the intermediate portion 414. The engagement flange portion 415 may be shaped to facilitate engagement with an operator's/user's finger. The pin 410 may further include a shank or shank portion 416 that descends from a bottom face or bottom surface 417 of the intermediate portion 414. As illustrated, the shank 416 may be smaller in diameter than the intermediate portion 414. As best illustrated in FIG. 11B, the bottom surface 417 of the intermediate portion 414 of the pin 410 may include a magnet 418.

Figure 12:
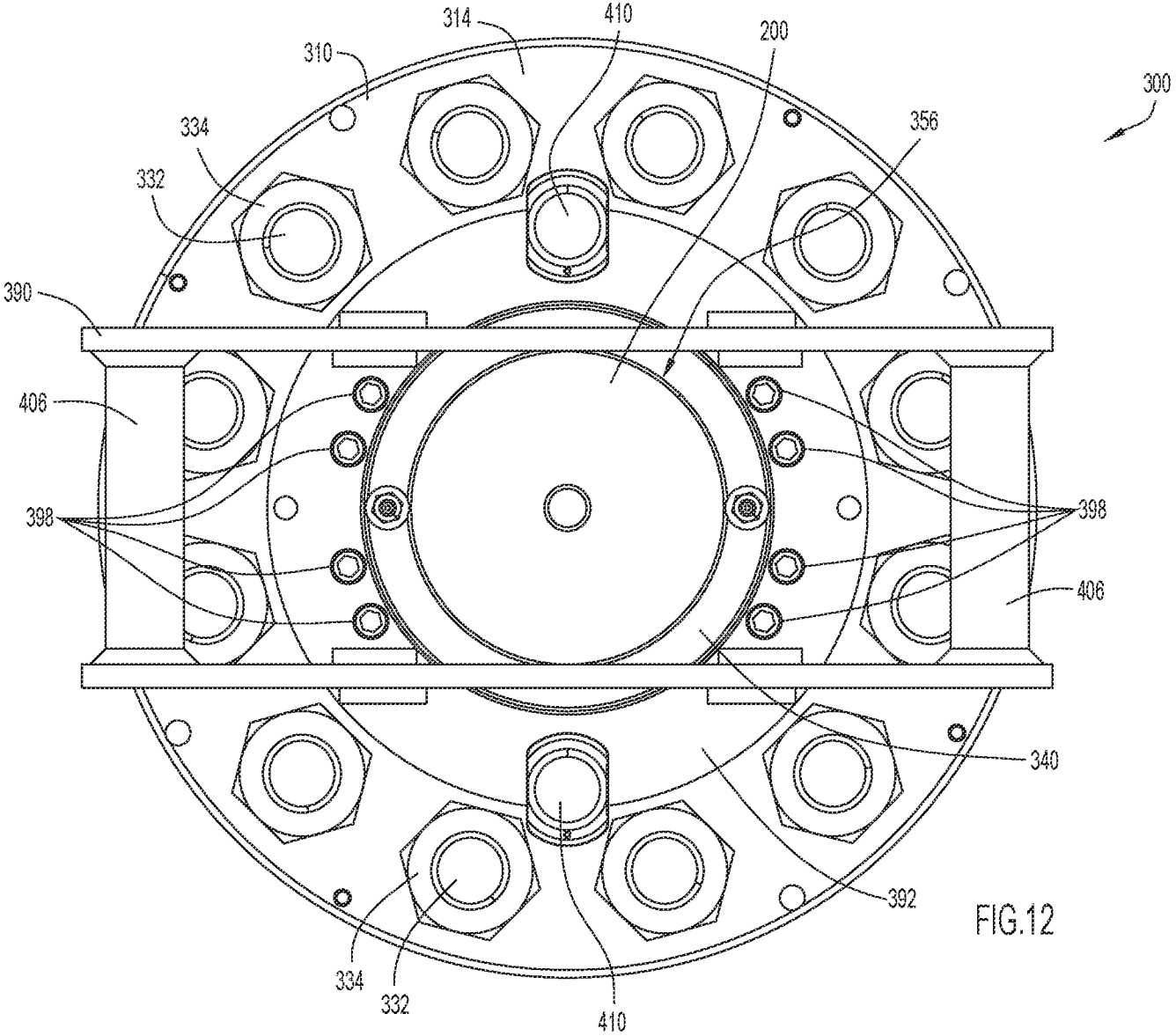
FIG. 12 illustrates a top view of the retainer assembly illustrated in FIG. 3.

As best illustrated in FIGS. 5 and 12, when the lock cover 340 is inserted into the lock cover bore 320 of the lock 310, and the lock cover 340 has been rotated such that external threads 380 of the lock cover 340 engage the internal threads 322 of the lock cover bore 320 of the lock 310 and such that the cutouts 399 of the lower ring portion 392 are aligned with the retainer bores 336 on the first end 314 of the lock 310, the shanks 416 of the pins 410 may be inserted through, and at least partially disposed within, both the cutouts 399 of the lower ring portion 392 and the retainer bores 336 on the first end 314 of the lock 310. This rotation prevention positioning of the pins 410 prevents rotation of the lock cover 340 with respect to the lock cover bore 320. In other words, the shanks 416 of the pins 410 being engaged with both the cutouts 399 of the lower ring portion 392 of the lock cover 340 and the retainer bores 336 of the lock 310 rotatably lock the lock cover 340 relative to the lock 310 in a position that prevents axial removal of the lock cover 340 from the lock 310 (due to the engagement of the external threads 380 of the lock cover 340 with the internal threads 322 of the lock cover bore 320 of the lock 310).

As further illustrated in FIG. 5, the bottom surface 417 of the intermediate portion 414 of the pins 410 may be in abutment with the lower ring portion 392. In some embodiments, the lower ring portion 392 may be constructed from ferromagnetic metals or other magnetically attractive materials such that the magnet 418 of the intermediate portion 414 of the pin 410 is attracted to the lower ring portion 392, which serves to secure the pins 410 in the rotation prevention position (i.e., the position shown in FIGS. 5 and 12 where the pins 410 prevent rotation of the lock cover 340 with respect to the lock cover bore 320 of the lock 310). The magnetic attraction between the magnet 418 of the pins 410 and the lower ring portion 392 may be strong enough to withstand and overcome vibrations imparted onto the lock 310 and the lock cover 340 by a hydraulic fluid pump 10.

In operation, as shown in FIGS. 2, 5, and 12, to assemble and secure the outlet valve 132 within the first service bore 126 of the fluid end 14, the lock 310 is fastened to the housing 100 of the fluid end 14 such that the lock 310 surrounds the first service bore 126 into which the outlet valve 132 and valve cover 200 will be inserted. Fasteners 332 may be inserted through the fastener bores 330 of the lock 310 to thread into the fastener bores (not shown) of the housing 100 of the fluid end 14. Nuts 334 may be threaded onto the fasteners 332 and may be tightened against the first axial end 314 of the lock 310, thereby securing the lock 310 to the housing 100 of the fluid end 14. The outlet valve 132 may be positioned through the lock 310 (i.e., inserted through the lock cover bore 320) and within the outlet bore 122 of the fluid end 14, and the first service bore 126 may then be sealed by the valve cover 200, which may also be inserted through the lock cover bore 320 of the lock 310. In some embodiments, the outlet valve 132 and valve cover 200 can be installed within the first service bore 126 prior to installation of the lock 310, though, as shown, the valve cover 200 and outlet valve 132 are removable and insertable through the lock 310 for replacement and initial assembly without removing the lock 310 from the housing 100 of the fluid end 14. The circumferential seal 228 on the cylindrical peripheral surface 224 of the valve cover 200 is energized by its placement within the first service bore 126, and does not need to be preloaded during installation.

The lock cover 340 is positioned above the lock cover bore 320 of the lock 310 and is rotatably aligned such that the gaps 324 between the broken thread segments 326 of the lock 310 are axially aligned with the broken thread segments 382 of the lock cover 340, and such that the broken thread segments 326 of the lock 310 are axially aligned with the gaps 384 between the broken thread segments 382 of the lock cover 340. The lock cover 340 is axially inserted (i.e., along central axis B) into the lock cover bore 320 of the lock 310 until the flange 378 of the main body 350 of the lock cover 340 abuts the first axial end 314 of the lock 310. As previously explained, the length of the lower portion 370 of the main body 350 of the lock cover 340 may be configured such that, when the flange 378 is in abutment with the first axial end 314 of the lock 310, the threads 380 of the lock cover 340 are axially displaced into alignment with the appropriate openings between threads 322 of the lock 310. When the threads 380 are axially positioned to be aligned as desired, the operator/user rotates the lock cover 340 relative to the lock 310, thereby engaging the threads 322, 380 with one another. When the threads 322, 380 are engaged with one another, the lock cover 340 is axially locked (prohibited from moving axially along central axis B) with respect to the lock cover bore 320 of the lock 310. Conversely, when the threads 322, 380 are not engaged with one another, the lock cover 340 is axially unlocked (free to move axially along central axis B) with respect to the lock cover bore 320 of the lock 310. The operator/user may rotate lock cover 340 until the cutouts 399 of the lower ring portion 392 of the handle 390 of the lock cover 340 are aligned with the retainer bore 336 in the first axial end 314 of the lock 310. The operator/user may then insert the shank 416 of each pin 410 into a cutout 399 and aligned retainer bore 336 until the bottom surface 417 of the intermediate portion 414 abuts the lower ring portion 392 of the handle 390 of the lock cover 340. As explained previously, when the shanks 416 of the pins 410 are inserted into both the cutouts 399 and the retainer bores 336, the lock cover 340 cannot be rotated relative to the lock 310 and cannot be axially removed from the lock cover bore 320 of the lock 310. Therefore, the pins 410 serve as a rotational lock that prohibits rotation of the lock cover 340 relative to the lock 310. The magnetic attraction between the magnet 418 of the intermediate portion 414 of the pins 410 and the lower ring portion 392 of the handle 390 of the lock cover 340 secures the pins 410 in the inserted position (i.e., the shanks 416 of the pins 410 being inserted into both the cutouts 399 and the retainer bores 336) until the operator/user manually removes the pins 410. When secure, the abutment surface 386 of the lock cover 340 is positioned in proximity to and/or in contact with the upper surface 212 of the first portion 210 of the valve cover 200, thereby preventing axial translation of the valve cover 200 away from the fluid end housing 100, even in response to increased pressure within the fluid end 14.

In operation, to remove the valve cover 200 or the outlet valve 132, the operator lifts pulls the pins 410 out of the cutouts 399 and the retainer bores 336. The interaction between the threads 322, 380 of the lock 310 and the lock cover 340 counteract the magnetic force between the magnet 418 and the lower ring portion 392 of the handle 390 of the lock cover 340 to facilitate removal the pins 410 from the retainer bores 336 and the cutouts 399. With the shanks 416 of the pins 410 removed from at least the retainer bores 336, the operator/user can rotate the lock cover 340 until the threads 322, 380 are disengaged from one another such that the threads 322 of the lock 310 are aligned with the gaps 384 of the lock cover 340 and the threads 380 of the lock cover 340 are aligned with the gaps 324 in the lock cover bore 320 of the lock 310. The lock cover 340 may then be axially removed from the lock cover bore 320 of the lock 310, and the valve cover 200 and outlet valve 132 are accessible for service and/or removal and replacement.

Figure 13:
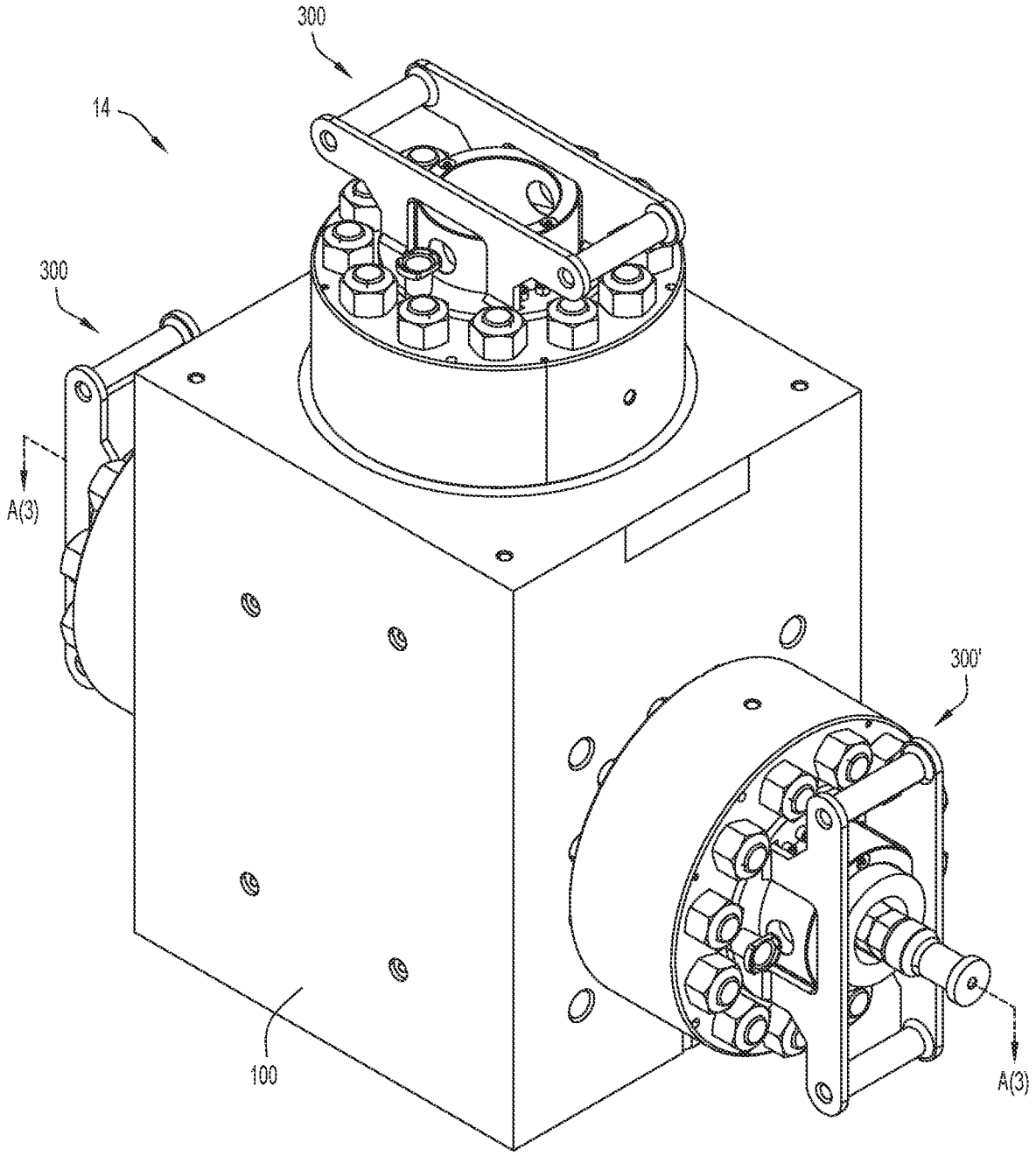
FIG. 13 illustrates a perspective view of a second embodiment of a retainer assembly coupled to a fluid end assembly of a hydraulic fluid pump.

Turning to FIG. 13, illustrated is a fluid end assembly 14 with two first embodiment retainer assemblies 300 (as described above with respect to FIGS. 2, 3, 4A, 4B, 5-10, 11A, 11B, and 12) coupled to the housing 100 of the fluid end assembly 14, and one second embodiment of the retainer assembly 300' that is coupled to the housing of the fluid end assembly 14 proximate to the piston bore 124. Both the first and second embodiments of the retainer assembly 300, 300' described herein may be utilized to secure various types of plug members within bores 120, 122, 124, 126, 128 of the housing 100. These plug members include the valve covers 200, as described above with respect to FIGS. 4A and 4B, but also include the liner 500 and piston 520 illustrated in FIGS. 16A, 16B, 17A, and 17B. The second embodiment of the retainer assembly 300' illustrated in FIGS. 13-15 and 18 may be substantially similar in structure and operation to the first embodiment of the retainer assembly 300 (i.e., the second embodiment of the retainer assembly 300' may contain the same or similar components as described above with respect to the first embodiment of the retainer assembly 300, including, but not limited to, the lock 310, the lock cover 340, and the pins 410) except that the second embodiment of the retainer assembly 300' may secures a liner 500 and piston 520 to the housing 100 instead of a valve cover 200.

Figure 14:
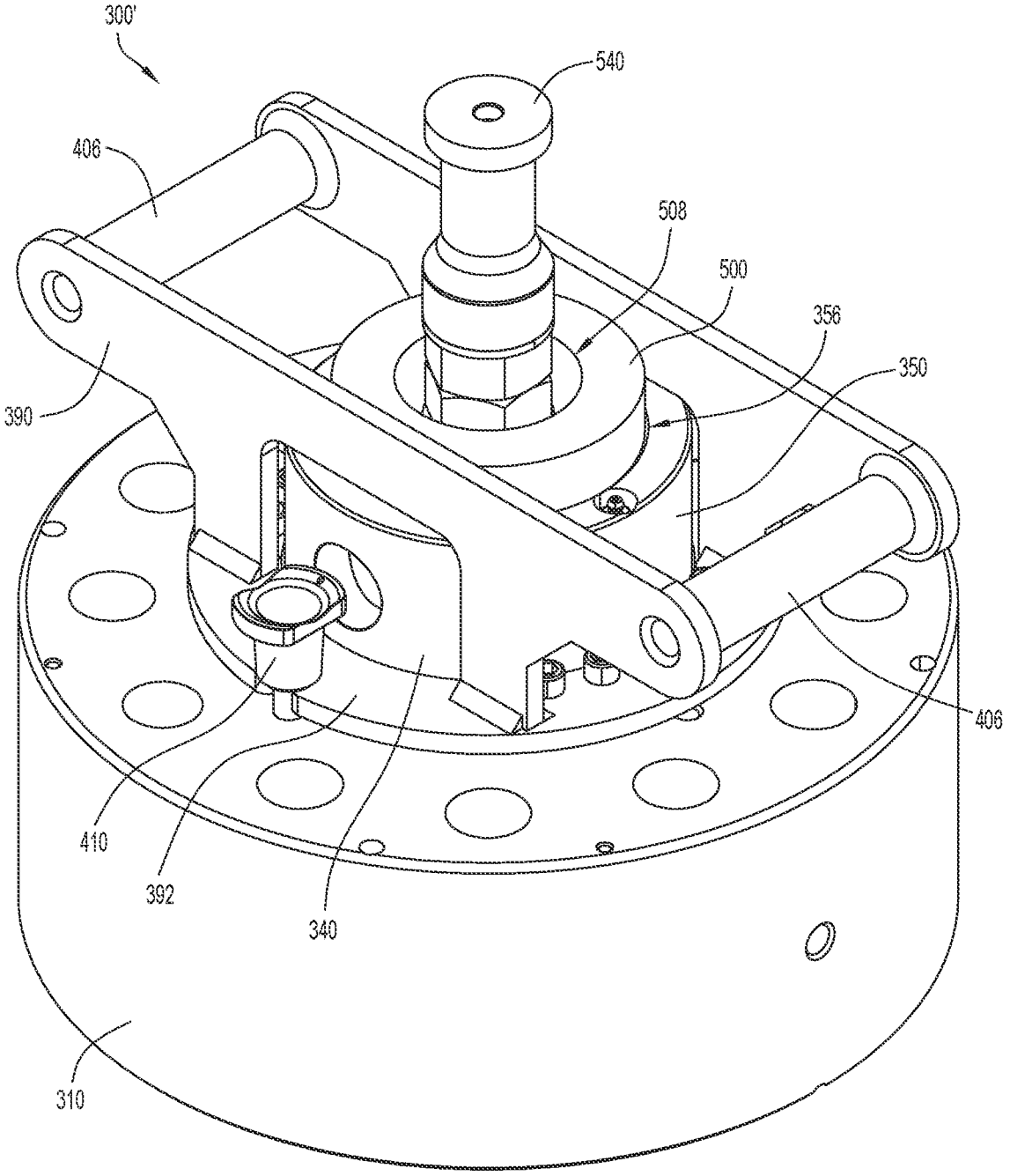
FIG. 14 illustrates a perspective view of the second embodiment of the retainer assembly illustrated in FIG. 13.
Figure 15:
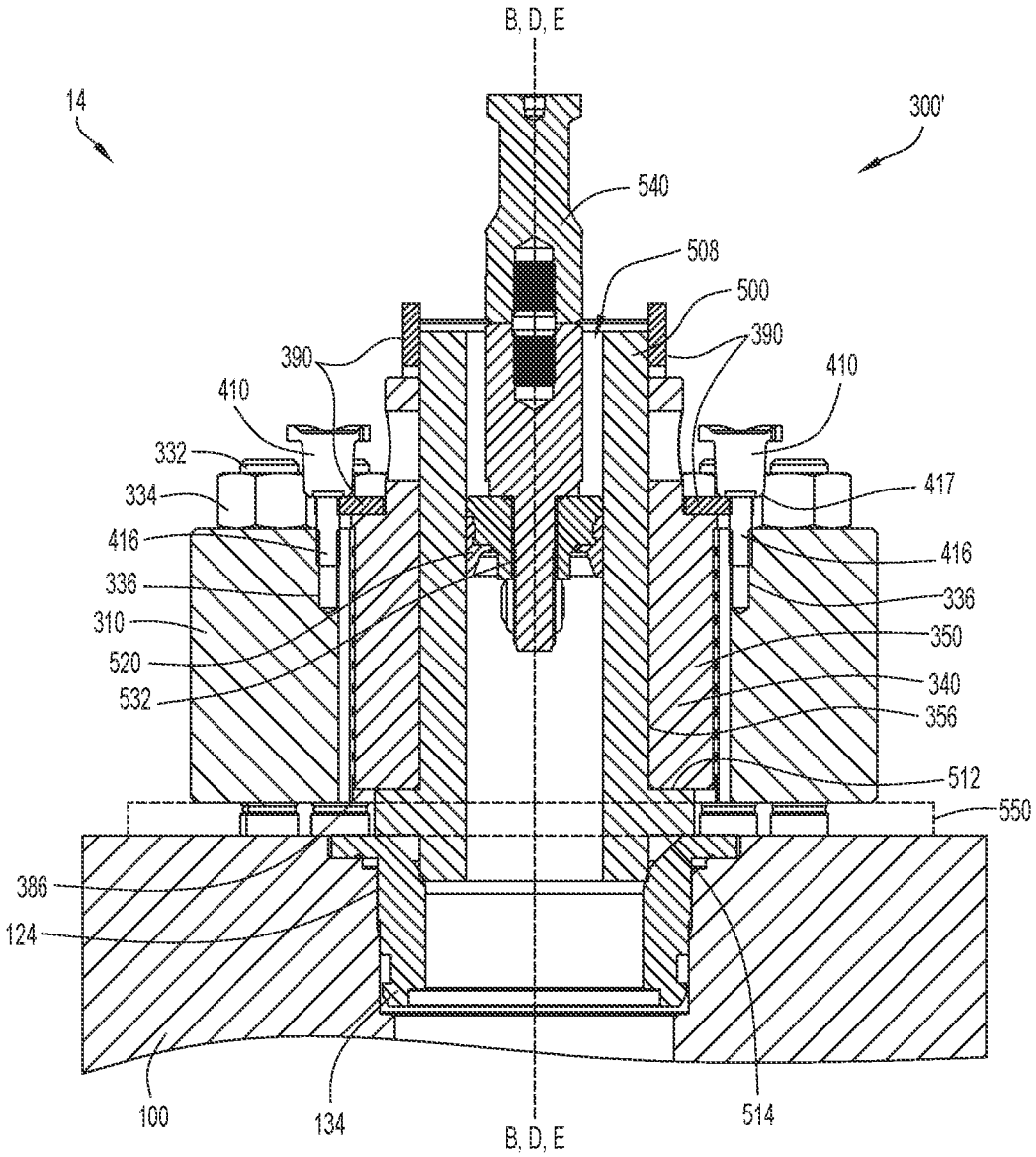
FIG. 15 illustrates a cross-sectional view taken along line A(3)-A(3) of the second embodiment of the retainer assembly illustrated in FIG. 13.
Figure 16A:
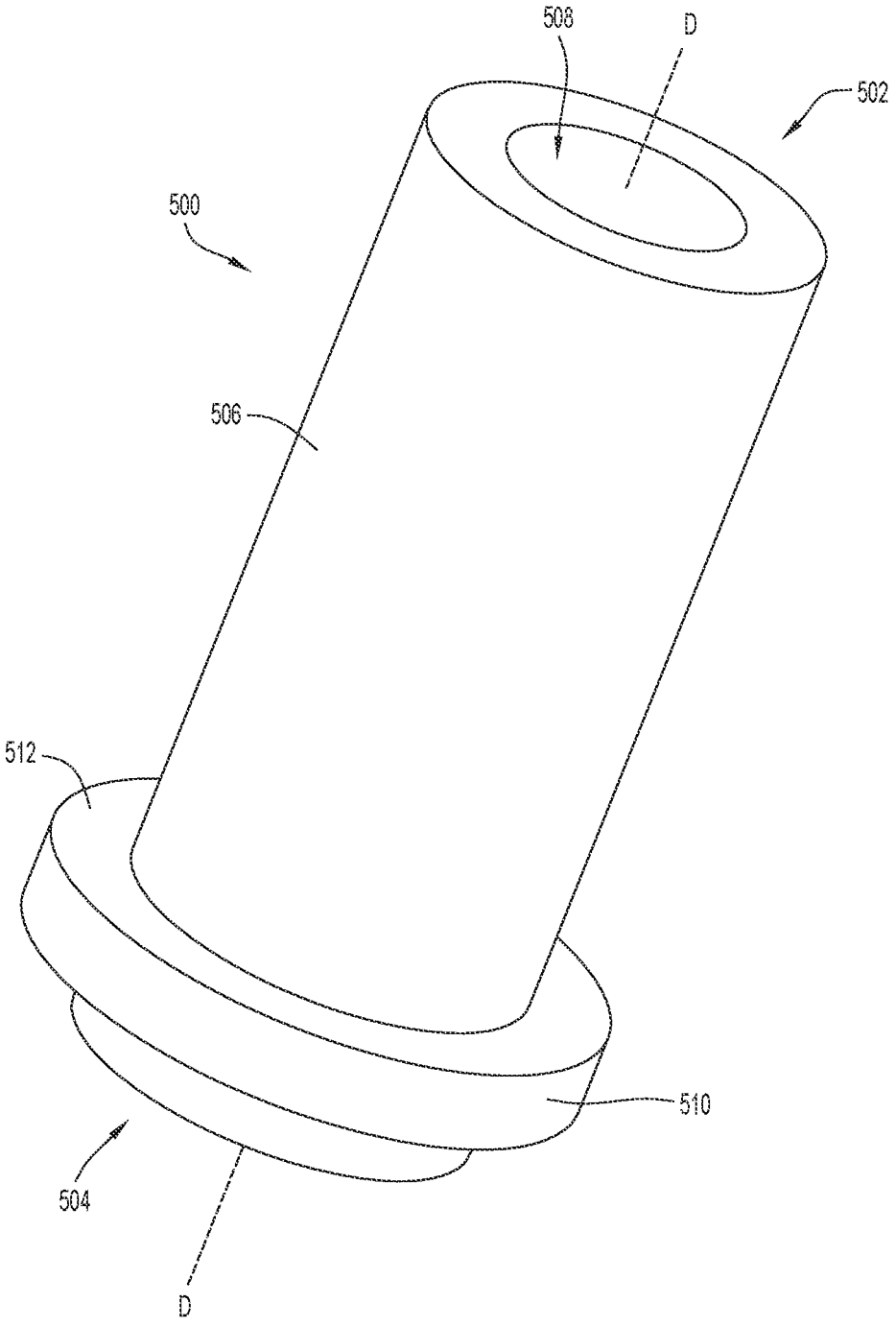
FIGS. 16A and 16B illustrate perspective views of a liner of the second embodiment of the retainer assembly illustrated in FIG. 14.
Figure 16B:
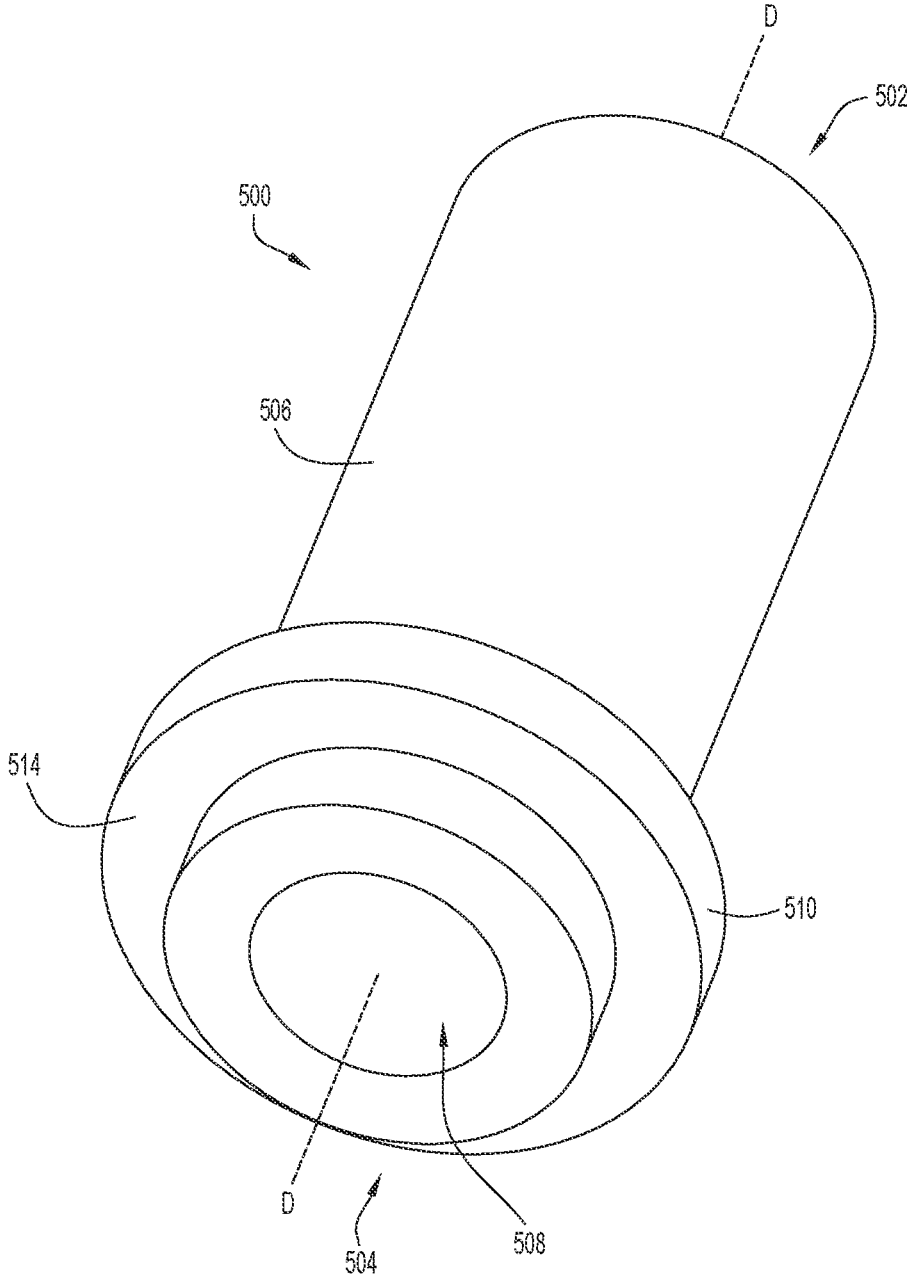
Figure 18:
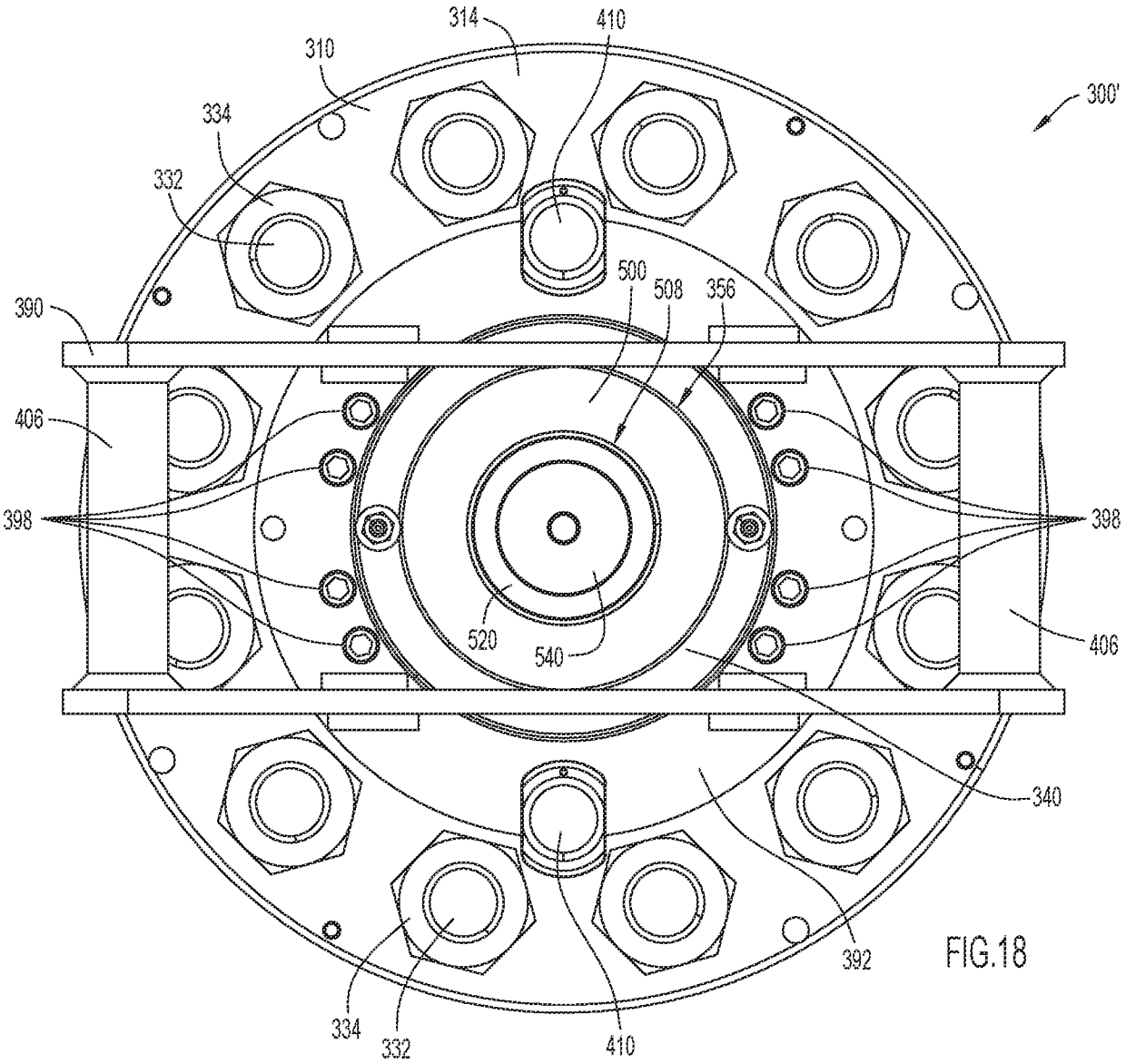
FIG. 18 illustrates a top view of the second embodiment of the retainer assembly illustrated in FIG. 14.

As best illustrated in FIGS. 16A and 16B, the liner 500 may be a substantially elongated plug member having a first end 502 and an opposite second end 504. The term liner as used herein may refer to a liner, a stuffing box, and/or a gland package that are configured to prevent the leakage of fluids between sliding or turning parts (e.g., pistons, plungers, etc.). While the illustrated embodiment of the liner 500 is substantially cylindrical, the liner 500 may be of any other shape. The liner 500 may further include a sidewall 506 spanning from the first end 502 to the second end 504. As further illustrated in FIGS. 16A and 16B, the liner 500 may also include a central conduit 508 spanning through the liner 500 from the first end 502 to the second end 504. The central conduit 508 may be centrally disposed in the liner 500 such that the central conduit 508 is coaxial with a central axis D of the liner 500 that extends through the first and second ends 502, 504 of the liner 500. In addition, the embodiment of the liner 500 illustrated may further include a flange 510 that extends radially outward from the sidewall 506 more proximate to the second end 504 than to the first end 502 of the liner 500. The flange 510 may define an upper surface 512 and an opposite lower surface 514. As best illustrated in FIGS. 14, 15, and 18, the diameter of the flange 510 may be greater than the diameter of the central bore 356 of the main body 350 of the lock cover 340, while the diameter of the remaining portions of the liner 500 may be substantially equal to, or slightly smaller than, the diameter of the central bore 356 of the main body 350 of the lock cover 340. Thus, when installed on the housing 100 as best illustrated in FIG. 15, the abutment surface 386 of the lock cover 340 may be disposed proximate to, or in abutment with, the upper surface 512 of the flange 510 of the liner 500, while the portion of the liner 500 disposed between the first end 502 and the flange 510 may extend through the central bore 356 of the main body 350 of the lock cover 340.

Figure 17A:
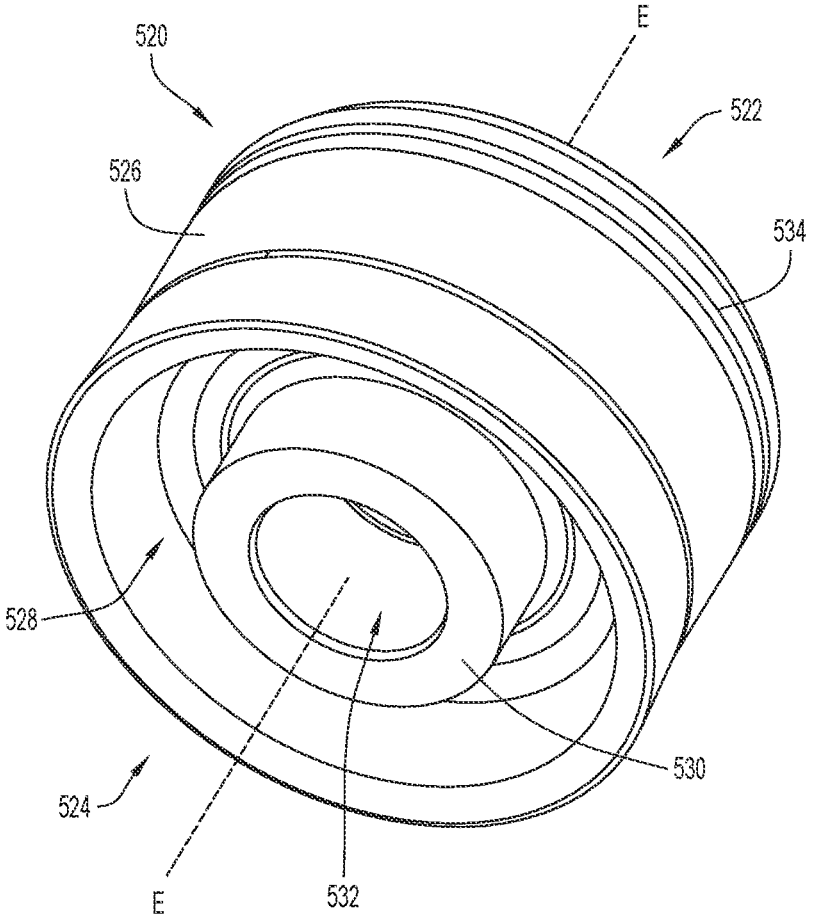
FIGS. 17A and 17B illustrate perspective views of a piston of the second embodiment of the retainer assembly illustrated in FIG. 14.
Figure 17B:
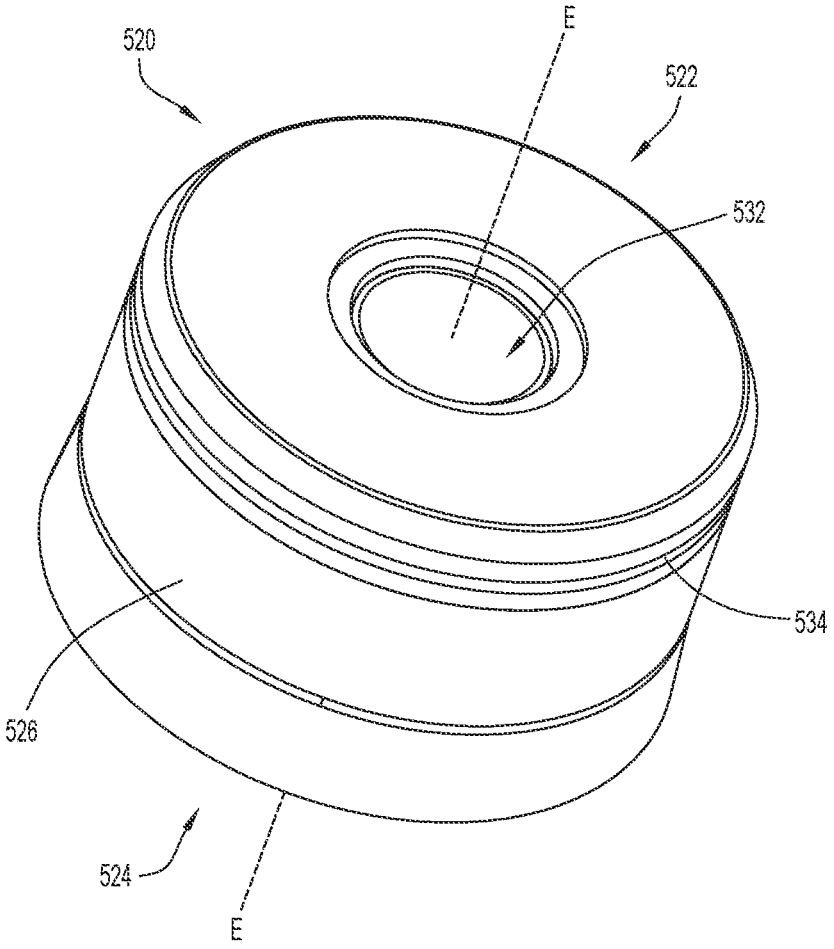

As best illustrated in FIGS. 17A and 17B, illustrated is a piston 520 that may be disposed within the central conduit 508 of the liner 500, and configured to slide or translate along the central conduit 508 of the liner 500 (i.e., along the central axis D of the liner 500). The term piston as used herein may refer to a piston or plunger that is configured to slide and/or turn through a liner, stuffing box, or gland package. The piston 520 may be substantially cylindrical in shape, and may have a first end 522 and an opposite second end 524. The piston 520 may further include a sidewall 526 spanning from the first end 522 to the second end 524. As best illustrated in FIG. 17A, the second end 524 of the piston 520 may include a cavity 528 and a protrusion 530 extending centrally through the cavity 528. Because the protrusion 530 extends centrally through the cavity 528, the cavity 528 may have an annular shape. As further illustrated in FIGS. 17A and 17B, the piston 520 further includes a central conduit 532 that extends through the piston 520 from the first end 522 to the second end 524. The central conduit 532 may be centrally disposed in the piston 520 such that the central conduit 532 is coaxial with a central axis E of the piston 520 that extends through the first and second ends 522, 524, as well as the protrusion 530 in the cavity 528, of the piston 520. Thus, the central conduit 532 extends through the protrusion 530 that extends through the cavity 528 of the piston 520. In other words, the protrusion 530 defines the circumference of portion of the central conduit 532 that extends through the cavity 528 of the piston 520. The sidewall 526 of the piston 520 may further include a channel 534 that extends circumferentially around the sidewall 526 proximate to the first end 522 of the piston 520. The channel 534 may be configured to receive a seal (not shown) that is configured to seal the piston 520 relative to the central conduit 508 of the liner 500. Thus, the seal may be energized with its placement within the central conduit 508 of the liner 500 by its frictional engagement with the central conduit 508. As best illustrated in FIGS. 14 and 15, the central conduit 532 of the piston 520 may be configured to receive a piston rod 540 that is configured to facilitate translation/movement of the piston 520 through the central conduit 508 of the liner 500.

The second embodiment of the retainer assembly 300' illustrated in FIGS. 13-15, 16A, 16B, 17A, 17B, and 18 may be secured to the housing 100 of the fluid end 14 proximate to the piston bore 124 of the housing of the fluid end 14 to removably secure the liner 500 and piston 520 to the housing 100 at the piston bore 124. In FIG. 15, the frame 550 of the pump 10, a portion of which may be disposed between the second axial end 316 of the lock 310 and the outer surface of the housing 100, is shown in phantom for illustrative purposes only. During assembly, the lock 310 may be fastened to the housing 100 of the fluid end 14 such that the lock 310 surrounds the piston bore 124 into which at least a portion of the liner will be inserted. The fasteners 332 may then be passed through the fastener bores 330 of the lock 310 to thread into the fastener bores (not shown) of the housing 100 of the fluid end 14. The nuts 334 may then be threaded onto the fasteners 332 and may then be tightened against the first axial end 314 of the lock 310, thereby securing the lock 310 to the housing 100 of the fluid end 14. The liner 500 may then be inserted through the lock cover bore 320 of the lock 310, and at least partially into the piston bore 124 such that the bottom surface 514 of the flange 510 of the liner 500 engages with piston retainer 134 disposed within the piston bore 124. In this position, the portion of the liner 500 disposed between the flange 510 and the first end 502 of the liner 500 may extend through the lock cover bore 320 of the lock 310. In some embodiments, the portion of the liner 500 disposed between the flange 510 and the second end 504 of the liner 500 or the bottom surface 514 of the flange 510 may contain a seal that is energized by its placement against the piston retainer 134 disposed within the piston bore 124.

Once the liner 500 has been placed within the piston bore 124, the lock cover 340 may be positioned above the lock cover bore 320 of the lock 310 and rotatably aligned such that the gaps 324 between the broken thread segments 326 of the lock 310 are axially aligned with the broken thread segments 382 of the lock cover 340, and such that the broken thread segments 326 of the lock 310 are axially aligned with the gaps 384 between the broken thread segments 382 of the lock cover 340. The lock cover 340 may be axially inserted (i.e., along central axis B) into the lock cover bore 320 of the lock 310 such that the liner 500 is inserted into the central bore 356 of the lock cover 340, and until the flange 378 of the main body 350 of the lock cover 340 abuts the first axial end 314 of the lock 310. As previously explained, the length of the lower portion 370 of the main body 350 of the lock cover 340 may be configured such that, when the flange 378 is in abutment with the first axial end 314 of the lock 310, the threads 380 of the lock cover 340 are axially displaced into alignment with the openings between the appropriate threads 322 of the lock 310. When the threads 380 are axially positioned to be aligned as desired, the operator/user rotates the lock cover 340 relative to the lock 310, thereby engaging the threads 322, 380 with one another. When the threads 322, 380 are engaged with one another, the lock cover 340 is axially locked (prohibited from moving axially along central axis B) with respect to the lock cover bore 320 of the lock 310. Conversely, when the threads 322, 380 are not engaged with one another, the lock cover 340 is axially unlocked (free to move axially along central axis B) with respect to the lock cover bore 320 of the lock 310. The operator/user may rotate the lock cover 340 until the cutouts 399 of the lower ring portion 392 of the handle 390 of the lock cover 340 are aligned with the retainer bore 336 in the first axial end 314 of the lock 310. Rotation of the lock cover 340 with respect to the lock 310 may also rotate the lock cover 340 with respect to the liner 500 at least partially disposed within the central bore 356 of the main body 350 of the lock cover 340. As previously described, the operator/user may then insert the shank 416 of each pin 410 into a cutout 399 and aligned retainer bore 336 until the bottom surface 417 of the intermediate portion 414 abuts the lower ring portion 392 of the handle 390 of the lock cover 340 in order to rotationally lock the rotational position of the lock cover 340 relative to the lock 310. The magnetic attraction between the magnet 418 of the intermediate portion 414 of the pins 410 and the lower ring portion 392 of the handle 390 of the lock cover 340 secures the pins 410 in the inserted position (i.e., the shanks 416 of the pins 410 being inserted into both the cutouts 399 and the retainer bores 336) until the operator/user manually removes the pins 410. Once the lock cover 340 is secured both rotationally and axially within the lock cover bore 320 of the lock 310, and, as a result, the liner 500 is secured to the housing 100, the piston 520 and the piston rod 540 may be inserted into the central conduit 508 of the liner 500. However, in other embodiments, the piston 520, and the piston rod 540 may be inserted into the liner 500 prior to installation of the liner 500 in the piston bore 124 of the housing, or prior to the lock cover 340 being inserted into the lock cover bore 320 of the lock 310. Once installed, the piston 520 may be movable along the central conduit 508 of the liner 500 to pressurize fluid within the interior volume 110 of the housing 100.

Figure 19:
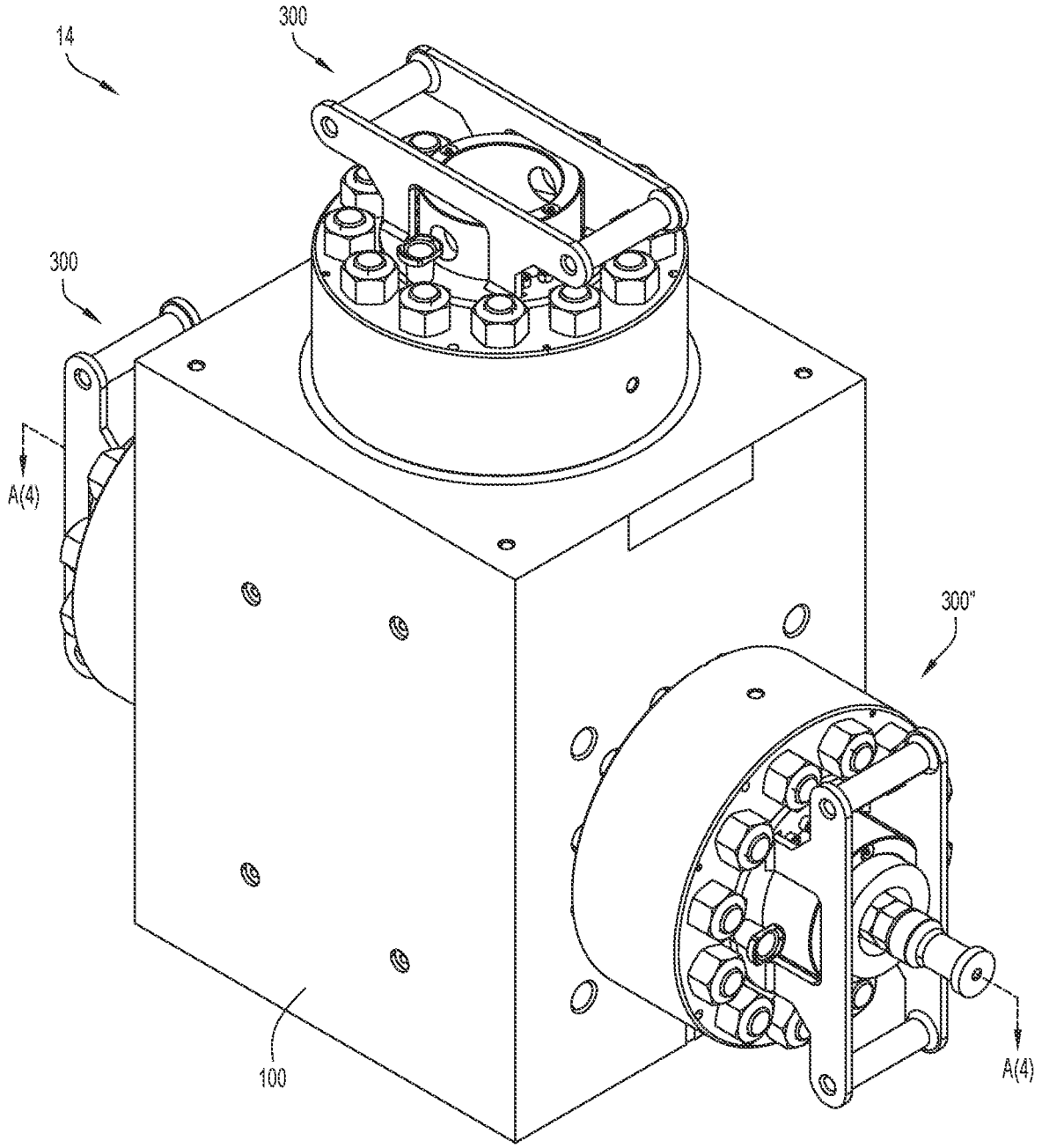
FIG. 19 illustrates a perspective view of a third embodiment of a retainer assembly coupled to a fluid end assembly of a hydraulic fluid pump.

Turning to FIG. 19, illustrated is a fluid end assembly 14 with two first embodiment retainer assemblies 300 (as described above with respect to FIGS. 2, 3, 4A, 4B, 5-10, 11A, 11B, and 12) coupled to the housing 100 of the fluid end assembly 14, and one third embodiment of the retainer assembly 300" that is coupled to the housing 100 of the fluid end assembly 14 proximate to the piston bore 124. While the first and second embodiments of the retainer assembly 300, 300' described above may be utilized to secure various types of plug members (e.g., valve covers 200, liners 500, pistons 520, stuffing boxes, plungers, etc.) within bores 120, 122, 124, 126, 128 of the housing 100, the third embodiment of the retainer assembly 300" integrates the liner and the main body 610 of the lock cover 600 into one uniform structure and may be configured secure a piston 520 in proximity to the piston bore 124 via the central bore 616 of the lock cover 600. Outside of the lock cover 600, the third embodiment of the retainer assembly 300" illustrated in FIGS. 19-21 may be substantially similar in structure and operation to the first and second embodiments of the retainer assembly 300, 300" (i.e., the third embodiment of the retainer assembly 300" may contain the same or similar components as described above with respect to the first and second embodiments of the retainer assembly 300, 300" including, but not limited to, the lock 310 and the pins 410).

The lock cover 600 of the third embodiment of the retainer assembly 300", like the lock cover 340, may include both a main body 610 and a handle 390 attached to the main body 610, but the main body 610 of the third embodiment of the retainer assembly 300" may differ from the main body 350 of the lock cover 340 while the handle 390 of the lock cover 600 remains substantially similar to the handle 390 of the lock cover 340.

Figure 20:
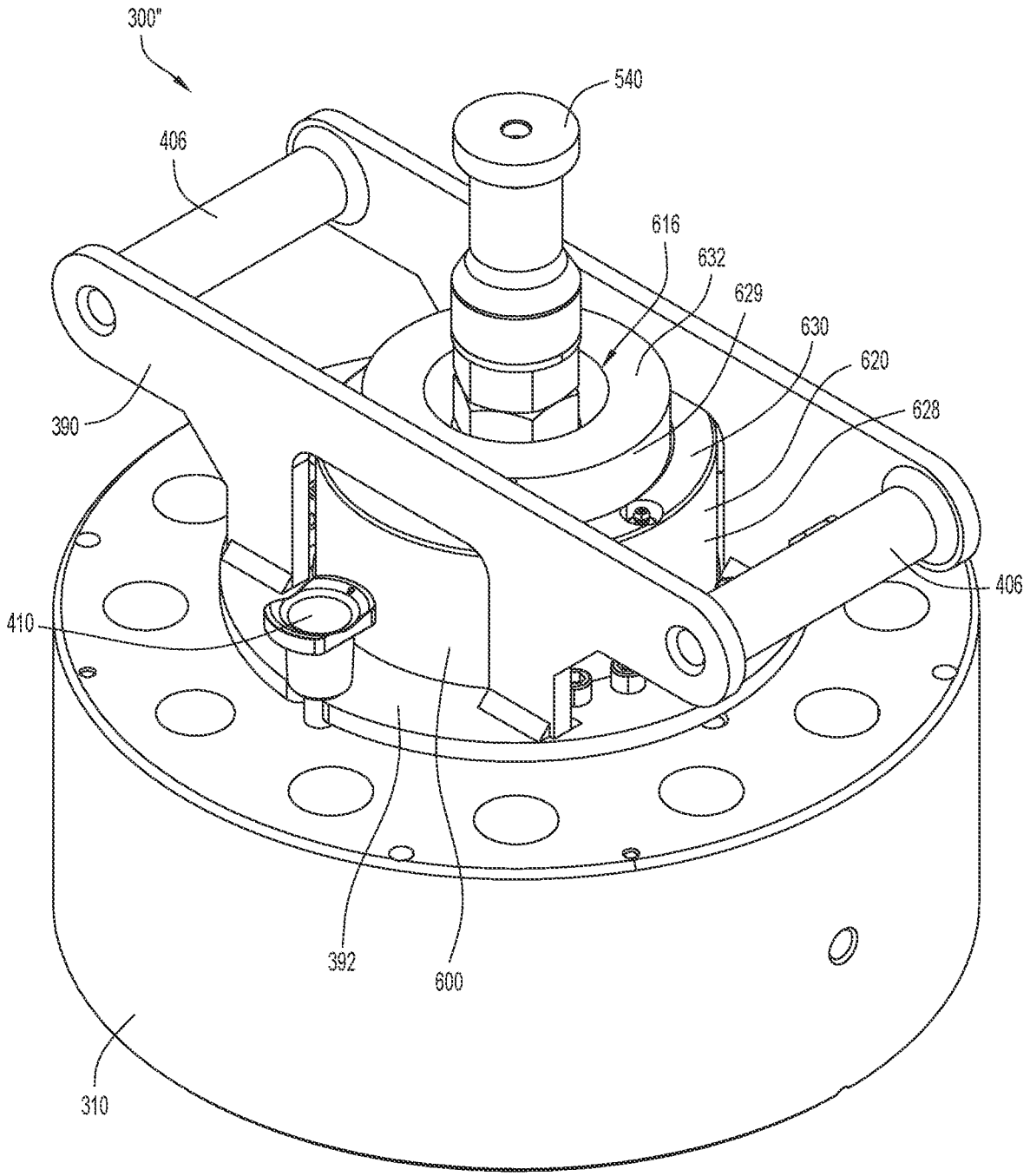
FIG. 20 illustrates a perspective view of the third embodiment of the retainer assembly illustrated in FIG. 19.
Figure 21:
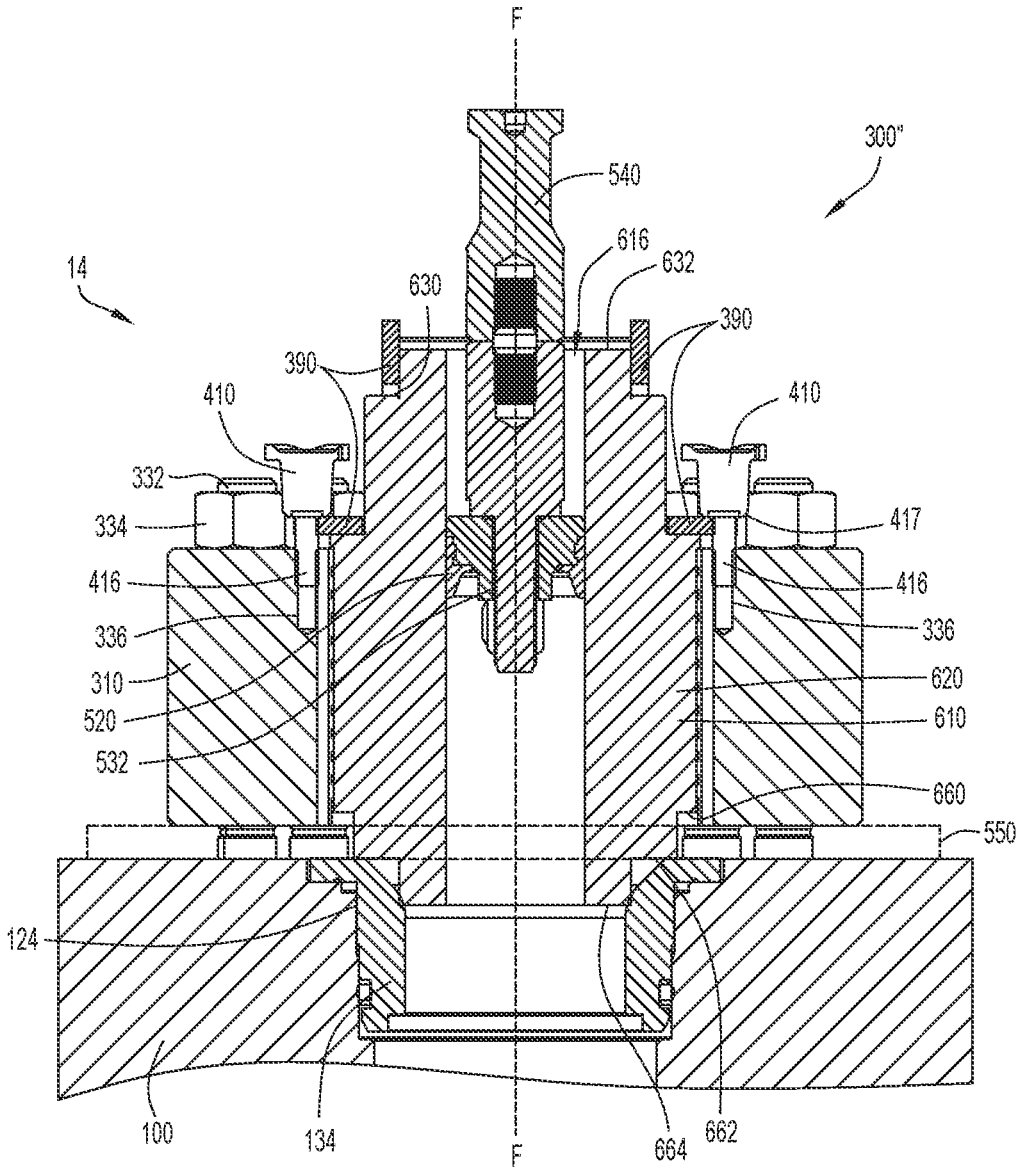
FIG. 21 illustrates a cross-sectional view taken along line A(4)-A(4) of the third embodiment of the retainer assembly illustrated in FIG. 19.
Figure 22A:
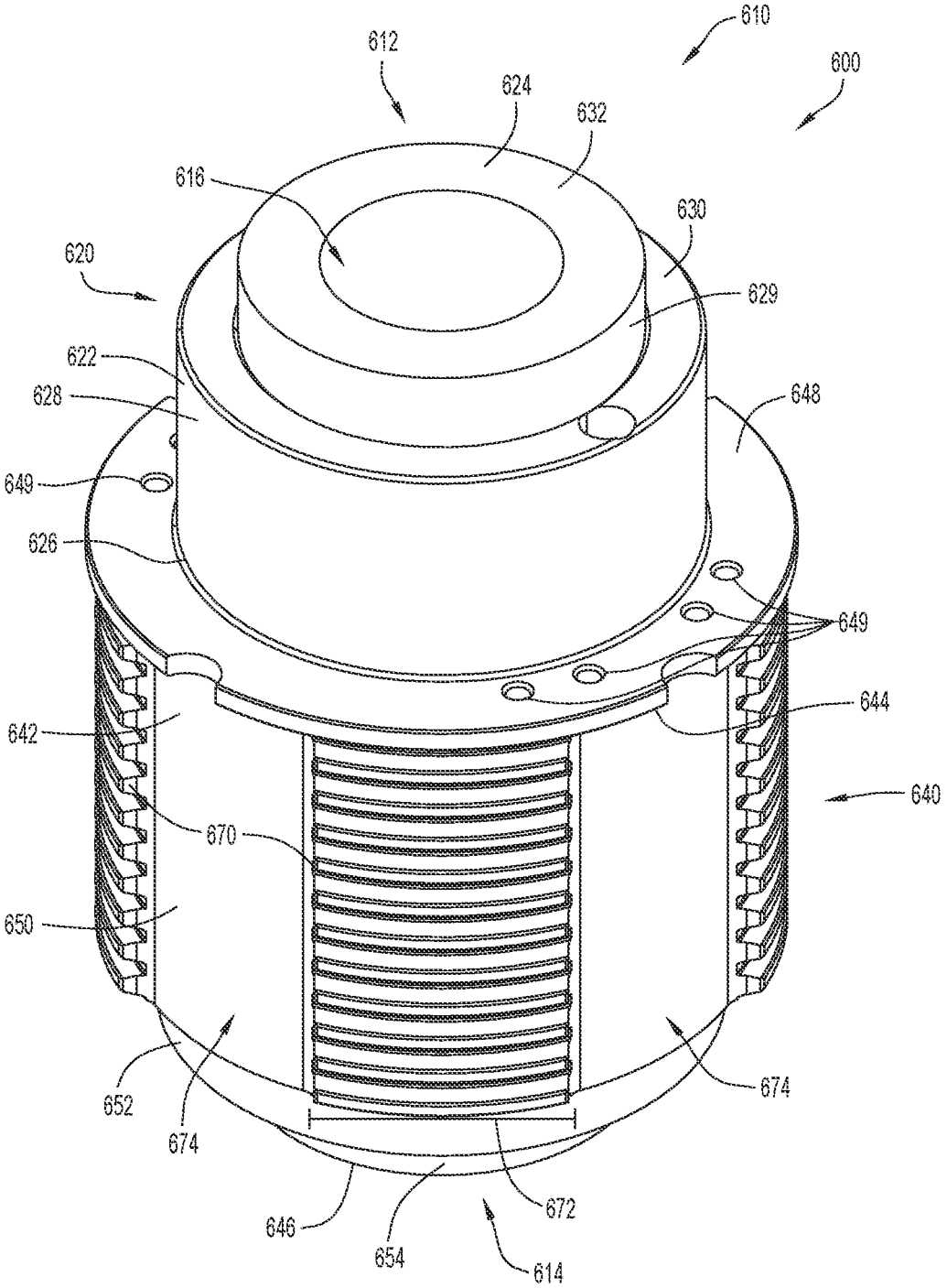
FIG. 22A illustrates a top perspective view of the main body of the lock cover of the third embodiment of the retainer assembly illustrated in FIG. 20.
Figure 22B:
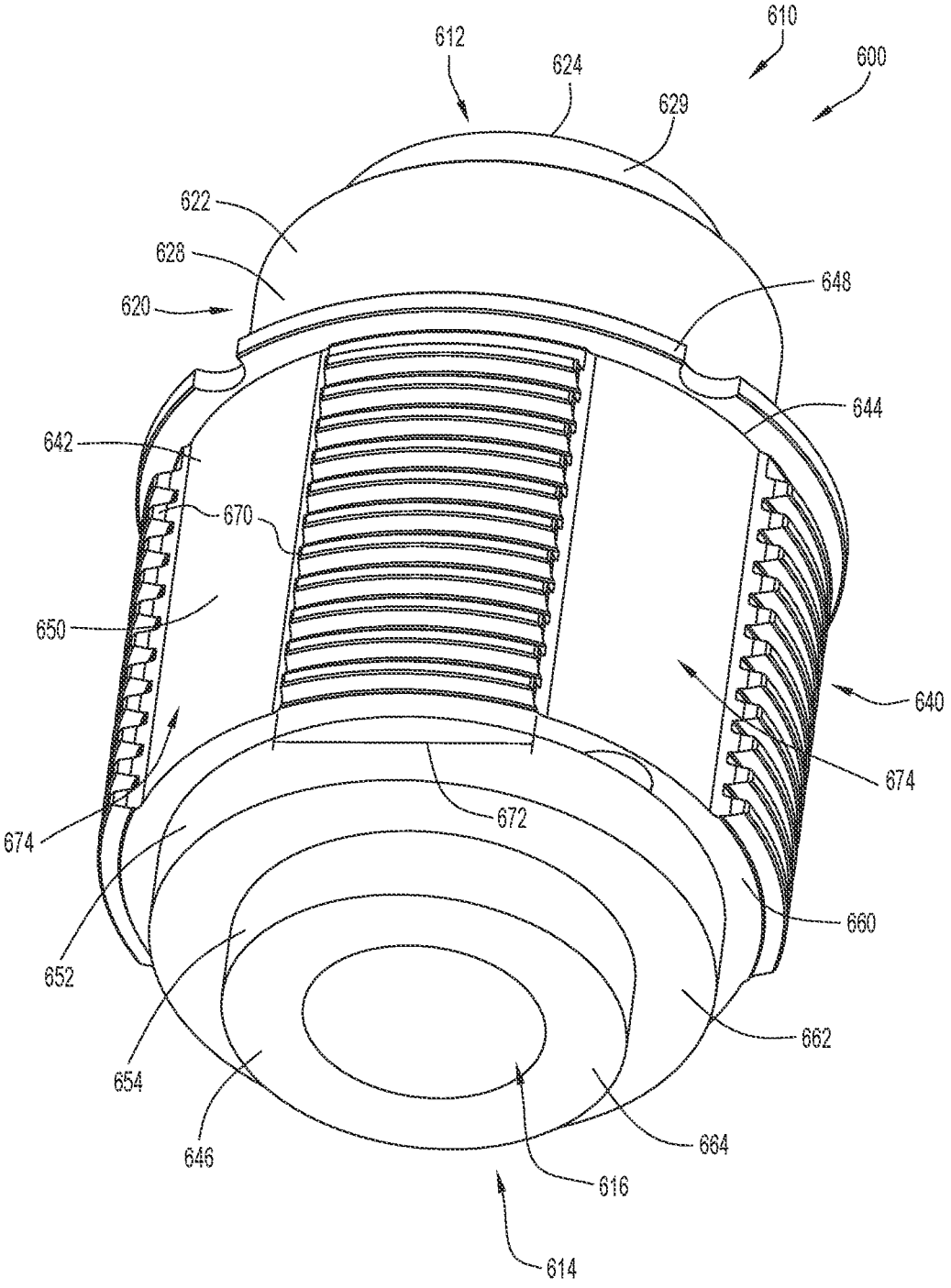
FIG. 22B illustrates a bottom perspective view of the main body of the lock cover of the third embodiment of the retainer assembly illustrated in FIG. 20.

As best illustrated in FIGS. 22A and 22B, illustrated are isolated (i.e., with the handle 390 removed) perspective views of the main body 610 of the lock cover 600. As best illustrated in FIGS. 20 and 21, the main body 610 of the lock cover 600 may be sized and shaped to fit within the lock cover bore 320 of the lock 310. As illustrated in FIGS. 22A and 22B, the main body 610 may have a first axial end 612 and a second axial end 614 opposite the first axial end 612. The main body 610 may also include a central bore 616 that extends through the main body 610 from the first axial end 612 to the second axial end 614. The diameter of the central bore 616 of the main body 610 of the lock cover 600 may be smaller than the diameter of the central bore 356 of the main body 350 of the lock cover 340. More specifically, the diameter of the central bore 616 of the main body 610 of the lock cover 600 may be substantially equal to the diameter of the central conduit 508 of the liner 500. Thus, as best illustrated in FIG. 21, the central bore 616 of the main body 610 may be configured to receive the piston 520 and at least a portion of the piston rod 540, which may be configured to translate or move along the central bore 616 of the main body 610.

As further illustrated in FIGS. 22A and 22B, the main body 610 may further include an upper portion 620 and a lower portion 640. The upper portion 620 may be substantially cylindrical with a sidewall 622 extending from a first end 624 to a lower end 626. The upper portion 620 may be a stepped structure with a first stepped segment 628 and a second stepped segment 629, the first stepped segment 628 having a larger diameter than the second stepped segment 629. As best illustrated in FIG. 22A, the first stepped segment 628 may have first concentric upper surface 630, and the second stepped segment 629 may have a second concentric upper surface 632. The second concentric upper surface 632 may form the first end 624 of the upper portion 620, which in turn may form the first axial end 612 of the main body 610. In other embodiments, the upper portion 620 may not have a stepped structure, and may include only a single upper surface that defines an opening to the central bore 616. In even further embodiments, the upper portion 620 may have a stepped structure with a larger number of stepped segments and concentric upper surfaces.

The lower portion 640 may also be substantially cylindrical with a sidewall 642 that extends from a first end 644 to a second end 646. Similar to the upper portion 620, the lower portion 640 may also be a stepped structure, but the lower portion 640 may include a first stepped segment 650, a second stepped segment 652, and a third stepped segment 654. The first stepped segment 650 may have a larger diameter than the second stepped segment 652 and the third stepped segment 654, while the second stepped segment 652 may have a larger diameter than the third stepped segment 654. Moreover, the first stepped segment 650 of the lower portion 640 may have a larger diameter than the first and second stepped segments 628, 629 of the upper portion 620.

As best illustrated in FIG. 22B, the first stepped segment 650 may have first concentric lower surface 660, the second stepped segment 652 may have a second concentric lower surface 662, and the third stepped segment 654 may have a third concentric lower surface 664. The third concentric lower surface 664 may form the second end 646 of the lower portion 640, which in turn may form the second axial end 614 of the main body 610. In other embodiments, the lower portion 640 may not have a stepped structure, and may include only a single horizontal lower surface that defines an opening to the central bore 616. In even further embodiments, the lower portion 640 may have a stepped structure with a larger or smaller number of stepped segments and concentric lower surfaces. In some even further embodiments, the lower portion 640 may have a tapered or substantially conical surface that tapers from the sidewall towards a central axis of the main body 610.

Continuing with FIGS. 22A and 22B, the first end 644 of the lower portion 640 may be coupled to the second end 626 of the upper portion 620. Disposed at the coupling of the first end 644 of the lower portion 640 to the second end 626 of the upper portion 620 is a flange 648, which may have a diameter that is larger than the first stepped segment 650 of the lower portion 640. Thus, the flange 648 may extend radially outward from main body 610 of the lock cover 600. Disposed on the upper surface of the flange 648 may be a plurality of attachment openings 649 (e.g., threaded bores) for securing the handle 390 to the main body 610.

As further illustrated in FIGS. 22A and 22B, the first stepped segment 650 of the lower portion 640 may be a threaded portion like that of the lock cover 340. Thus, the first stepped segment 650 of the lower portion 640 may include external threads 670 that are similar to the internal threads 322 of the lock cover bore 320 and the external threads 380 of the lock cover 600. Thus, the external threads 670 may be broken zero-pitch threads sized to engage the broken zero-pitch threads 322 of the lock cover bore 320. In the embodiment shown, the first stepped segment 650 of the lower portion 640 of the main body 610 of the lock cover 600 may include eleven threads 670 that are configured to engage within the twelve threads 322 of the lock cover bore 320. In other embodiments, the lower portion 640 of the main body 610 may include any number of threads 670. The threads 670 are broken such that broken thread segments 672, which are separated from one another by gaps 674, of the external threads 670 fit within the gaps 324 between the broken thread segments 326 in the lock cover bore 320 (i.e., the external broken thread segments 672 of the lock cover 600 are equal to or less than the size of the gaps 324 in the lock cover bore 320) and the arrangement of the external broken thread segments 672 allow them to each be aligned with, and placed within, respective gaps 324 in the lock cover bore 320. As the external threads 670 are broken, the external threads 670 of the lock cover 600 are engaged with the lock cover bore 320 of the lock 310 by first axially inserting the lock cover 600 into the lock cover bore 320 with the external broken thread segments 672 of the lock cover 600 positioned in the gaps 324 defined between the internal broken thread segments 326 of the lock cover bore 320. Once the lock cover 600 is axially positioned within the lock cover bore 320 of the lock 310, the lock cover 600 may be rotated relative to the lock cover bore 320 so that the threads 322, 670 engage one another. For the illustrated embodiment, this includes rotating the lock cover 600 by 45 degrees with respect to the lock cover bore 320. In some embodiments, one pair of mating threads 322, 670 (e.g., the lowest threads) of the lock cover bore 320 and the lock cover 600, respectively, may be larger and/or spaced apart at a greater distance from one another than the remainder of threads 322, 670 so that the lock cover 600 is only capable of engaging the lock cover bore 320 at one axial position along the axial length of the lock cover bore 320. In other embodiments, the length of the lower portion 640 (i.e., the length between the first and second ends 644, 646 of the lower portion 640) may be sized (e.g., have a predetermined set length) so that the threads 322, 670 of the lock cover bore 320 and the lock cover 600, respectively, are aligned to facilitate a mating engagement of the threads 322, 670 when the flange 648 of the main body 610 of the lock cover 600 is in abutment with the first axial end 314 of the lock 310. As best illustrated in FIG. 21, the second and third concentric lower surfaces 662, 664 of the of the lower portion 640 of the main body 610 of the lock cover 600 abuts or contacts the piston retainer 134 when the lock cover 600 is installed within the lock cover bore 320 of the lock 310.

Installation and operation of the third embodiment of the retainer assembly 300" onto the housing 100 of the fluid end 14 may be substantially similar to that of the second embodiment of the retainer assembly 300'. The third embodiment of the retainer assembly 300" illustrated in FIGS. 19-21 may be secured to the housing 100 of the fluid end 14 proximate to the piston bore 124 of the housing of the fluid end 14 to removably secure the piston 520 to the housing 100 proximate to the piston bore 124. In FIG. 21, the frame 550 of the pump 10, a portion of which may be disposed between the second axial end 316 of the lock 310 and the outer surface of the housing 100, is shown in phantom for illustrative purposes only. During assembly, the lock 310 may be fastened to the housing 100 of the fluid end 14 such that the lock 310 surrounds the piston bore 124. The fasteners 332 may then be passed through the fastener bores 330 of the lock 310 to thread into the fastener bores (not shown) of the housing 100 of the fluid end 14. The nuts 334 may then be threaded onto the fasteners 332 and may then be tightened against the first axial end 314 of the lock 310, thereby securing the lock 310 to the housing 100 of the fluid end 14. The lock cover 600, which, as described above, may incorporate an integrated piston liner, may be positioned above the lock cover bore 320 of the lock 310 and rotatably aligned such that the gaps 324 between the broken thread segments 326 of the lock 310 are axially aligned with the broken thread segments 672 of the lock cover 600, and such that the broken thread segments 326 of the lock 310 are axially aligned with the gaps 674 between the broken thread segments 672 of the lock cover 600. The lock cover 600 may be axially inserted (i.e., along central axis F illustrated in FIG. 21) into the lock cover bore 320 of the lock 310 such that the flange 648 of the main body 610 of the lock cover 600 abuts the first axial end 314 of the lock 310. The length of the lower portion 640 of the main body 610 of the lock cover 600 is set/predetermined such that, when the flange 648 is in abutment with the first axial end 314 of the lock 310, the second and third concentric lower surfaces 662, 664 of the lock cover 600 may be disposed proximate to, or in abutment with, the piston retainer 134. In addition, in this axially lowered position, the threads 670 of the lock cover 600 are axially displaced into alignment with the appropriate openings between threads 322 of the lock 310. When the threads 670 are axially positioned to be aligned as desired, the operator/user may then rotate the lock cover 600 relative to the lock 310, thereby engaging the threads 322, 670 with one another. When the threads 322, 670 are engaged with one another, the lock cover 600 is axially locked (prohibited from moving axially along central axis F) with respect to the lock cover bore 320 of the lock 310. Conversely, when the threads 322, 670 are not engaged with one another, the lock cover 600 is axially unlocked (free to move axially along central axis F) with respect to the lock cover bore 320 of the lock 310. The operator/user may rotate the lock cover 600 until the cutouts 399 of the lower ring portion 392 of the handle 390 of the lock cover 340 are aligned with the retainer bore 336 in the first axial end 314 of the lock 310. As previously described, the operator/user may then insert the shank 416 of each pin 410 into a cutout 399 and aligned retainer bore 336 until the bottom surface 417 of the intermediate portion 414 abuts the lower ring portion 392 of the handle 390 of the lock cover 600 in order to rotationally lock the rotational position of the lock cover 600 relative to the lock 310. The magnetic attraction between the magnet 418 of the intermediate portion 414 of the pins 410 and the lower ring portion 392 of the handle 390 of the lock cover 600 secures the pins 410 in the inserted position (i.e., the shanks 416 of the pins 410 being inserted into both the cutouts 399 and the retainer bores 336) until the operator/user manually removes the pins 410. Once the lock cover 600 is secured both rotationally and axially within the lock cover bore 320 of the lock 310, the piston 520 and the piston rod 540 may be inserted into the central bore 616 of the main body 610 of the lock cover 600. However, in other embodiments, the piston 520, and the piston rod 540 may be inserted into the central bore 616 of the main body 610 of the lock cover 600 prior to installation of the lock cover 600 into the lock cover bore 320 of the lock 310. Once installed, the piston 520 may be movable along the central bore 616 of the lock cover 600 to pressurize fluid within the interior volume 110 of the housing 100.

In even further embodiments, the lock covers 340, 600 described herein may be secured directly (without the lock 310 described herein) to the housing 100 to secure plug members (e.g., valve covers 200, liners 500, pistons 520, stuffing boxes, plungers, etc.) in positions proximate to, or within, the bores 120, 122, 124, 126, 128 of the housing 100. In these embodiments, the bores 120, 122, 124, 126, 128 may be sized and shaped to directly receive the lock covers 340, 600. Moreover, the bores 120, 122, 124, 126, 128 may contain the same or similar broken zero-pitch thread arrangement (i.e., thread segments and gaps, etc.) described above with respect to the lock cover bore 320 of the lock 310 to facilitate axially insertion and rotation of the lock covers 340, 600 within the bores 120, 122, 124, 126, 128. In this embodiment, the housing 100 may contain retainer bores disposed proximate to the bores 120, 122, 124, 126, 128, and that are configured to receive the shank 416 of the pins 410 to rotational lock the lock covers 340, 600 within the bores 120, 122, 124, 126, 128.

In some even further embodiments, the components (especially the threads 322, 380, 670) of the retainer assemblies 300, 300', 300" described herein may be constructed from corrosion resistant materials, including, but not limited to, being nickel plated. By constructing the components of the retainer assemblies 300, 300', 300" from corrosion resistant materials, the life of the retainer assemblies 300, 300' 300" is extended.

While the apparatuses presented herein have been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. For example, the lock presented herein may be modified to be of any shape, and contain any number of fastener openings, lock cover bores, retainer bores, threads, thread segments, and/or gaps between thread segments. Moreover, the lock cover presented herein may also be of any shape, and may contain any number of handles, cutouts, threads, thread segments, and/or gaps between thread segments. In addition, the main body and the handle of the lock cover presented herein may also be integrally formed from one uniform material (rather than being two structures fastened to one another).

In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Accordingly, it is appropriate that the appended claims be construed broadly and in a manner consistent with the scope of the disclosure as set forth in the following claims.

It is also to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention. Additionally, it is also to be understood that the components of the fluid pump described herein, the fluid end assembly described herein, the plug members described herein, the retainer assemblies described herein, or portions thereof may be fabricated from any suitable material or combination of materials, such as, but not limited to, plastic or metals (e.g., nickel, copper, bronze, aluminum, steel, etc.), as well as derivatives thereof, and combinations thereof. In addition, it is further to be understood that the steps of the methods described herein may be performed in any order or in any suitable manner.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about", "around", "generally", and "substantially."

What is claimed is:

1. A fluid end assembly of a hydraulic fluid pump, the fluid end assembly comprising:
a housing having a bore;
a plug member positioned at least partially within the bore; and
a lock cover coupled to the housing and configured to retain the plug member within the bore during operation of the fluid end assembly, wherein the lock cover comprises:
a main body comprising a flange; and
a handle comprising a ring portion coupled to the flange of the main body, wherein the handle comprises an upstanding portion coupled to a planar surface of the ring portion, an elongated portion extending from the upstanding portion, and an engagement portion extending from the elongated portion at a distal end of the elongated portion, and the distal end is positioned radially exterior of the flange.

2. The fluid end assembly of claim 1, comprising an additional elongated portion extending at least partially in overlap with the flange, wherein the engagement portion extends between the elongated portion and the additional elongated portion at the distal end.

3. The fluid end assembly of claim 2, comprising an additional engagement portion extending between the elongated portion and the additional elongated portion at an additional distal end of the elongated portion.

4. The fluid end assembly of claim 1, wherein the fluid end assembly comprises a pin extending through the flange of the main body and the ring portion of the handle to rotationally lock a position of the lock cover relative to the housing.

5. The fluid end assembly of claim 4, further comprising a lock coupled to the housing, wherein the lock comprises a retainer bore formed through a surface of the lock, the main body of the lock cover extends into the lock, and the pin extends through the retainer bore of the lock.

6. The fluid end assembly of claim 5, wherein the flange of the main body is configured to abut the surface of the lock.

7. The fluid end assembly of claim 1, wherein the flange of the main body comprises an opening, the handle comprises an aperture, the opening and the aperture are configured to align with one another, and the fluid end assembly further comprises a fastener configured to extend through the opening of the main body and the aperture of the handle to couple the handle to the main body.

8. The fluid end assembly of claim 1, wherein the engagement portion of the handle of the lock cover extends across the main body of the lock cover.

9. A method of assembling a fluid end of a hydraulic fluid pump, the method comprising:
inserting a plug member into a bore of a housing of the fluid end;
coupling a handle to a main body of a lock cover by inserting an extended portion of the lock cover into an opening of the handle to abut a ring portion of the handle against a flange of the main body, wherein the ring portion defines the opening of the handle, the handle comprises a pair of elongated portions extending across the opening of the handle, as well as an engagement portion extending between and connected to the pair of elongated portions at a distal end of the pair of elongated portions, the distal end being positioned radially exterior of the flange; and
coupling the main body of the lock cover to the housing via the engagement portion of the handle such that the lock cover is positioned over the plug member and retaining the plug member in the bore.

10. The method of claim 9, further comprising inserting a pin through the flange of the main body to secure the lock cover to the housing.

11. The method of claim 9, wherein coupling the handle to the main body of the lock cover further comprises inserting a fastener through an opening of the flange of the main body and an aperture of the handle.

12. The method of claim 9, further comprising:
coupling a lock to the housing; and
coupling the lock cover to the lock.

13. The method of claim 12, wherein coupling the lock to the housing comprises inserting a fastener through an additional bore of the lock.

14. The method of claim 12, wherein coupling the lock cover to the lock comprises extending a part of the main body into a threaded bore of the lock and threadedly engaging the main body with the threaded bore.

15. The method of claim 14, wherein coupling the lock cover to the lock further comprises using the engagement portion to rotate the handle and the lock cover to threadedly engage the main body with the threaded bore.

16. A fluid end assembly of a hydraulic fluid pump, the fluid end assembly comprising:
a housing having a first bore;
a plug member positioned at least partially within the first bore;
a lock coupled to the housing and having a second bore; and
a lock cover configured to extend into the second bore of the lock and retain the plug member within the first bore during operation of the fluid end assembly, wherein the lock cover comprises:
a main body comprising a flange; and
a handle comprising a ring portion, an engagement portion, and an elongated portion, wherein the ring portion defines an opening, the elongated portion extends across the opening, and the engagement portion extends from the elongated portion at a distal end of the elongated portion, the distal end being positioned radially exterior of the flange of the main body.

17. The fluid end assembly of claim 16, further comprising a fastener configured to extend through the flange of the main body and the lock to couple the lock cover to the lock.

18. The fluid end assembly of claim 17, wherein the flange of the main body comprises a cutout, the lock comprises a retainer bore, and the fastener is configured to extend through the cutout and the retainer bore to couple the lock cover to the lock.

19. The fluid end assembly of claim 18, wherein the handle comprises an additional cutout, and the fastener is configured to extend through the additional cutout.

20. The fluid end assembly of claim 19, wherein the flange of the main body comprises an additional opening, the ring portion of the handle comprises an aperture, and the fluid end assembly further comprises an additional fastener configured to extend through the additional opening of the flange of the main body and the aperture of the handle to couple the handle and the main body to one another.

* * * * *